US005239341A

United States Patent [19]

Ishida et al.

[11] Patent Number: 5,239,341

[45] Date of Patent: Aug. 24, 1993

[54] IMAGE PROCESSING APPARATUS HAVING VARIABLE MAGNIFICATION CONTROL

[75] Inventors: Masato Ishida, Kanagawa; Makoto Miura, Tokyo; Kazuki Miyamoto, Kanagawa, all of Japan

[73] Assignee: Canon Kabushiki Kaisha, Tokyo, Japan

[21] Appl. No.: 758,713

[22] Filed: Sep. 9, 1991

Related U.S. Application Data

[63] Continuation of Ser. No. 267,665, Nov. 3, 1988, abandoned, which is a continuation of Ser. No. 674,593, Nov. 26, 1984, abandoned.

[30] Foreign Application Priority Data

| | | | |
|---|---|---|---|
| Nov. 25, 1983 | [JP] | Japan | 58-220588 |
| Nov. 25, 1983 | [JP] | Japan | 58-220595 |
| Nov. 26, 1983 | [JP] | Japan | 58-222911 |
| Nov. 26, 1983 | [JP] | Japan | 58-222912 |
| Nov. 26, 1983 | [JP] | Japan | 58-222913 |
| Nov. 26, 1983 | [JP] | Japan | 58-222914 |
| Nov. 26, 1983 | [JP] | Japan | 58-222915 |
| Nov. 26, 1983 | [JP] | Japan | 58-222916 |
| Nov. 26, 1983 | [JP] | Japan | 58-222917 |
| Nov. 26, 1983 | [JP] | Japan | 58-222918 |

[51] Int. Cl.[5] ..... G03G 21/00

[52] U.S. Cl. ..... 355/206; 355/214; 355/243

[58] Field of Search ..... 355/200, 206, 208, 210, 355/243, 214

[56] References Cited

U.S. PATENT DOCUMENTS

| | | | |
|---|---|---|---|
| 4,153,364 | 5/1979 | Suzuki et al. | 355/214 |
| 4,162,396 | 7/1979 | Howard et al. | 355/206 X |
| 4,213,693 | 7/1980 | Imai et al. | 355/245 |
| 4,215,930 | 8/1980 | Miyakawa et al. | 355/208 |
| 4,260,248 | 4/1981 | Murata et al. | 355/243 X |
| 4,287,461 | 9/1981 | Promis et al. | 355/235 X |
| 4,305,653 | 12/1981 | Evanitsky | 355/209 |
| 4,332,461 | 6/1982 | Cail et al. | 355/243 |
| 4,361,395 | 11/1982 | Washio et al. | 355/214 |
| 4,461,564 | 7/1984 | Ikenoue | 355/243 |
| 4,501,490 | 2/1985 | Miyamoto et al. | 355/243 X |
| 4,512,655 | 4/1985 | Ishida et al. | 355/243 X |
| 4,536,079 | 8/1985 | Lippolis et al. | 355/206 |
| 4,542,985 | 9/1985 | Honma et al. | 355/208 X |
| 4,552,450 | 11/1985 | Tomosada et al. | 355/243 |
| 4,571,061 | 2/1986 | Osano et al. | 355/243 |
| 4,598,994 | 7/1986 | Tomosada et al. | 355/200 |
| 4,640,603 | 2/1987 | Honma | 355/214 |

FOREIGN PATENT DOCUMENTS

| | | |
|---|---|---|
| 2811792 | 9/1978 | Fed. Rep. of Germany . |
| 57-204564 | 12/1982 | Japan . |
| 1598121 | 9/1981 | United Kingdom . |

*Primary Examiner*—Fred L. Braun

*Attorney, Agent, or Firm*—Fitzpatrick, Cella, Harper & Scinto

[57] ABSTRACT

An image processing apparatus has a mechanism for setting a desired magnification of a reproduced image, a display for displaying the selected magnification, an optical system for forming an image on a transfer medium, and a control unit. The control unit controls the optical system so as to form the desired magnified image even when the setting of a desired magnification changes. The control unit can also include a first timer for effecting a timing operation based on a predetermined time irrespective of input magnification and a second timer for effecting a timing operation based on the input magnification with a predetermined time relation to the first timer. In addition, the apparatus can include a first device for directly setting a magnification for image formation corresponding to a position of a movable member in accordance with a converted digital value and a second device for setting a predetermined specified magnification irrespective of the position of the movable member, or a device for selecting a retained magnification or a magnification corresponding to the position to the movable member changed before completion of image formation, without changing the position of the movable member after the completion of the image formation.

30 Claims, 27 Drawing Sheets

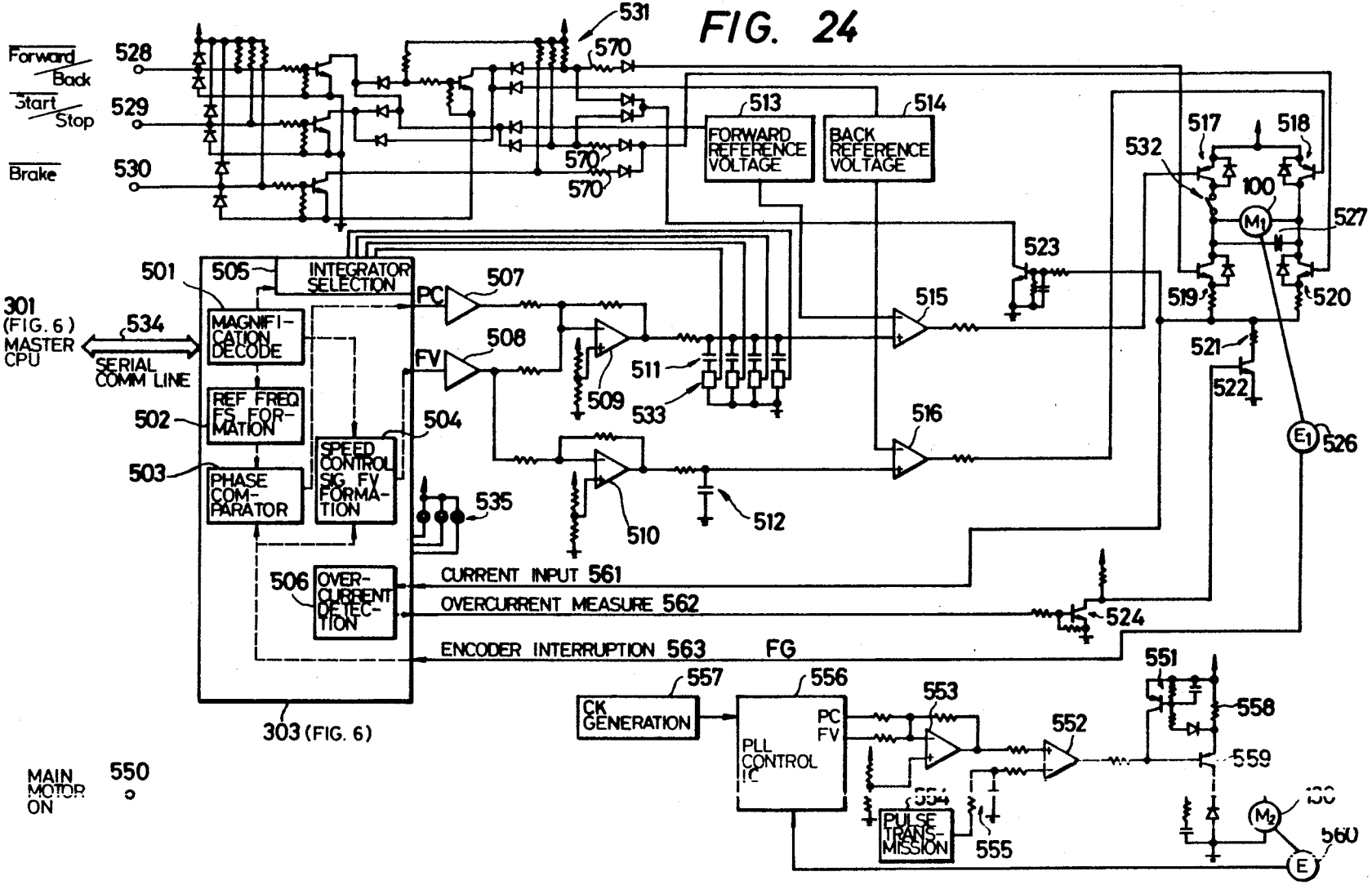
FIG. 24
BACK REFERENCE VOLTAGE
FORWARD REFERENCE VOLTAGE
INTEGRATOR SELECTION
MAGNIFI-CATION DECODE
REF FREQ FS FOR-MATION
PHASE COM-PARATOR
SPEED CONTROL SIG. FV FORMA-TION
OVER-CURRENT DETEC-TION
PC
FV
CURRENT INPUT 561
OVERCURRENT MEASURE 562
ENCODER INTERRUPTION 563
FG
PC FV
PLL CONTROL IC
CK GENERATION
PULSE TRANS-MISSION
SERIAL COMM LINE
MASTER CPU
MAIN MOTOR ON
Forward
Back
Start
Stop
Brake
303 (FIG. 6)
301 (FIG. 6)

IMAGE PROCESSING APPARATUS HAVING VARIABLE MAGNIFICATION CONTROL

This application is a continuation of application Ser. No. 07/267,665, filed Nov. 3, 1988, now abandoned, which is a continuation of application Ser. No. 06/674,593, filed Nov. 26, 1984, now abandoned.

BACKGROUND OF THE INVENTION

1. Field of the Invention

The present invention relates to an image processing apparatus which can reproduce images with different magnifications.

2. Description of the Prior Art

In order to copy at a given magnification using a conventional image processing apparatus such as a copying machine or copy unit, a desired magnification is inputted with ten keys or a special key for setting a copy magnification is used. In order to display the copy magnification preset in this manner, a display for displaying the copy magnification must be used.

In a conventional image processing apparatus of this type, a special key for setting the copy magnification or a display is used, so that the total number of keys or displays used is increased. The number of input/output operations to be performed then becomes large, the operation complex, and the operability poor.

A unit which allows stepless setting of a magnification is known. A variable resistor can be conveniently used for this purpose since it is easy to handle and inexpensive. However, unlike other input means, such as a key switch, a preset value is altered when a human hand brushes the unit irrespective of the read of inhibition mode, thus resulting in inconvenience.

In addition, when the magnification is sequentially changed in stepless fashion, the magnification which is being thus set must be displayed to an operator. When a display means for this purpose is incorporated, cost of the overall apparatus becomes high.

When a size change (magnification change) is performed with a conventional image processing apparatus, the margin at the leading edge of a copy is inadvertently changed, thus degrading the copy quality A means for stepless change of magnification using a zoom lens has also been proposed. In a conventional means of this type, the control means is complex, and the positioning precision is low.

A copy unit has been proposed wherein a density of an original image is detected, and an exposure or a developing bias is controlled in accordance with the detected density, so that a copy image of an optimal density is obtained. In order to detect the original density, an extra original scanning step other than a normal copy operation must be performed. For this reason, a change from a manual density control mode to an automatic density control mode cannot be made during the copy operation. When the preset density becomes improper during copy operation of a plurality of copies in the manual density control mode, the copy operation must be stopped to change the mode to the automatic density control mode or the density must be manually adjusted while the first few defective copies are discarded.

Since the function to be controlled in an apparatus wherein a density is automatically changed is a heat source such as an exposure lamp or a fixing heater or is a high voltage source, if a normal control operation cannot be performed due to mechanical trouble, the problem of safety arises. Conventionally, when trouble occurs, the operator determines the cause and takes countermeasures. For this reason, an extra load is applied to the exposure lamp or the like, and the lamp life is shortened. A secondary effect on IC parts or the like cannot be avoided.

A photosensitive body used in an image formation apparatus changes its characteristics upon irradiation with light over a long period of time. These changes have a great effect on image quality and determine the life of the photosensitive body. In order to compensate for such changes in the characteristics of the photosensitive body, a method has been proposed for detecting the sensitivity of the photosensitive body and to control the light quantity or the high voltage applied to it. This method requires a complex arrangement and results in an expensive device.

In a conventional image formation apparatus of this type such as a copy unit, when phase lock loop control of a DC motor as a drive source is performed, a phase difference of the phase control cannot be easily determined, and control requires a considerable period of time.

In such a conventional apparatus, the copy operation is controlled by a motor for driving a photosensitive drum or by a drum clock generator mounted on a movable portion driven by the motor. An abnormality is detected only when no drum clock is detected. When such an abnormality is detected, the copy operation is stopped, and the abnormality is displayed. However, satisfactory control cannot be performed when two or more motors are used.

A driver is generally used to drive a scanner motor. However, when an erratic operation due to noise or an abnormality is caused for unexplained reason, the motor cannot be protected from a surge voltage.

When the copy unit must be stopped immediately for whatever reason, for example, when jamming occurs in this type of apparatus, the motor is stopped when jamming is detected. After the jamming is cleared, the optical system is returned to the home position and the next copy operation is started. Thus, the procedure for resuming the copy operation is time-consuming. In a copy unit of the type wherein an original table is moved relative to the optical system, due to the original table not being stopped at the home position, other operations may be interfered with. Especially when a DC motor is used to move the original table, the table cannot be easily moved manually, thus requiring complex preparation for resuming operations.

SUMMARY OF THE INVENTION

It is an object of the present invention to provide an image processing apparatus which is free from the drawbacks of conventional apparatuses.

It is another object of the present invention to provide an image processing apparatus which has a size change input section which is easy to operate.

It is still another object of the present invention to provide an image processing apparatus which has an inexpensive size change input section.

It is still another object of the present invention to provide an image processing apparatus which has a display section for displaying size change parameters which are easy to discriminate.

It is still another object of the present invention to provide an image processing apparatus which can prevent an erroneous size change during an image formation operation.

It is still another object of the present invention to provide an image processing apparatus which can display a selected size by a method suitable for allowing multistep size change input.

It is still another object of the present invention to provide a recording apparatus which can form a margin of a predetermined size on a recording paper sheet regardless of a selected magnification.

It is still another object of the present invention to provide an image processing apparatus which can position a lens by moving it for a short distance in accordance with a selected magnification.

It is still another object of the present invention to provide an image processing apparatus which allows selection of an image density adjustment mode at any time.

It is still another object of the present invention to provide an improvement in a copy unit which can reproduce an image of an optimal density by detecting an original density.

It is still another object of the present invention to provide a copy unit which can detect an abnormality using a density detecting means.

It is still another object of the present invention to provide an image processing apparatus which can correct to obtain a constant adjustment range of a density control means when a sensitivity of a photosensitive body changes.

It is still another object of the present invention to provide an improvement in an image processing apparatus which performs drive control of a scanner or a photosensitive body.

It is still another object of the present invention to provide an improvement in a copy unit having a phase lock loop speed control unit for an optical scanner for performing stepless size change.

It is still another object of the present invention to provide an original scanning apparatus or a recording apparatus in which a phase shift of phase locked loop control for a motor for driving a scanner or a photosensitive body is displayed.

It is still another object of the present invention to provide a method and apparatus which allow self-diagnosis of an abnormal speed of a drive source of an image recording apparatus having more than one drive source and upon detection of such abnormality display it or stop an image recording operation.

It is still another object of the present invention to provide an improvement in a safety unit which stops a scanner drive motor of an image recording apparatus when an abnormality is caused in the image recording mode.

It is still another object of the present invention to provide an original scanning apparatus or a recording apparatus having a drive section which generates only low level noise.

It is still another object of the present invention to provide an image processing apparatus which can resume image processing immediately after an abnormality is corrected.

The above and other objects, features and advantages of the present invention will become apparent from the following description taken in conjunction with the accompanying drawings.

BRIEF DESCRIPTION OF THE DRAWINGS

FIG. 12 is a representation showing the sheet feed state;

FIG. 24 is a circuit diagram of a speed control circuit for controlling speeds of an optical system drive motor and a photosensitive drum drive motor;

DETAILED DESCRIPTION OF THE PREFERRED EMBODIMENTS

Figure 1:
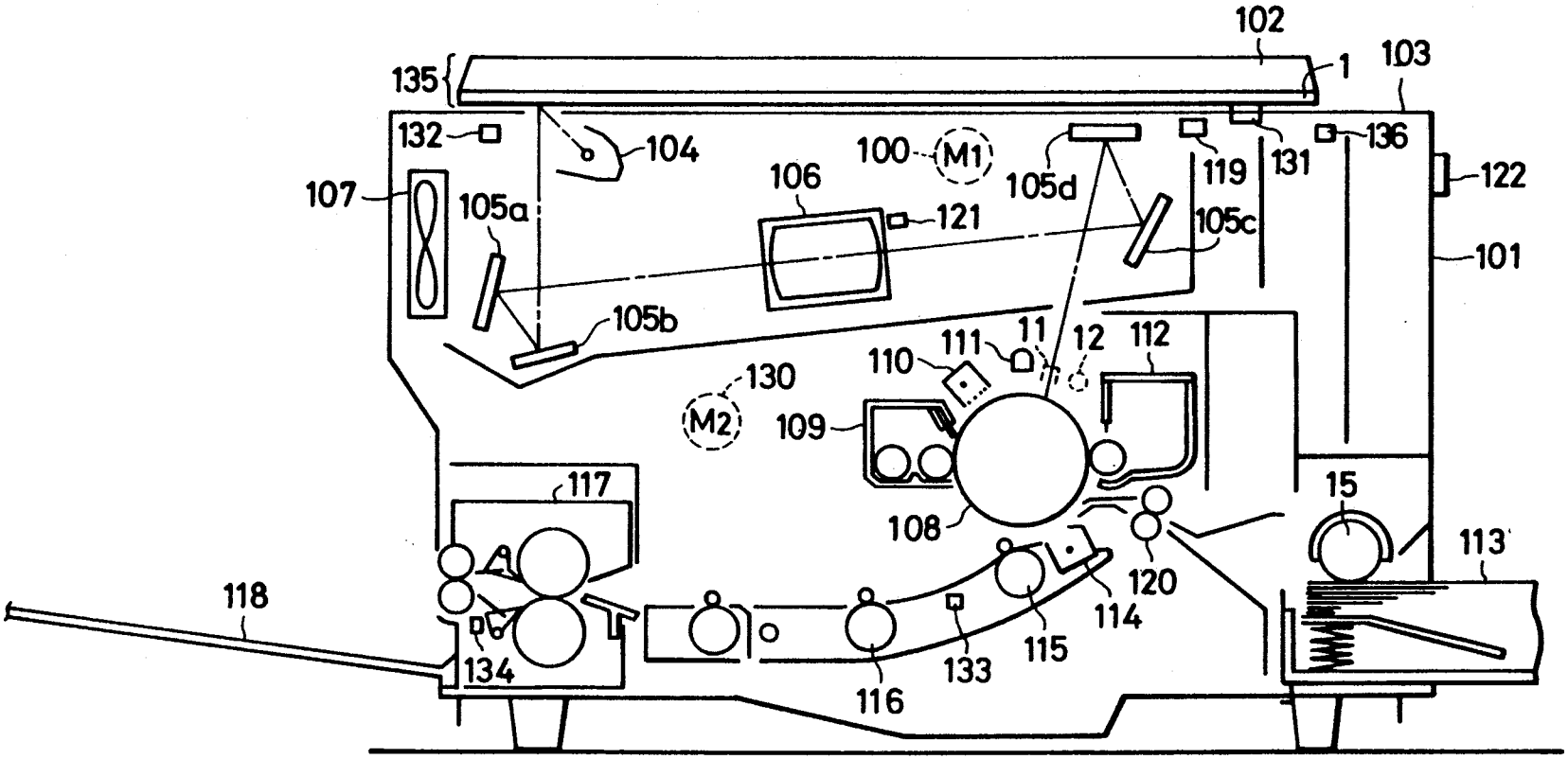
FIG. 1 is a view schematically showing the arrangement of a copy unit according to an embodiment of the present invention.

The preferred embodiment of the present invention will be described with reference to FIGS. 1 to 5. This embodiment is exemplified with reference to a copy unit.

The copy unit according to this embodiment will now be described with reference to FIG. 1. An original to be copied is placed on a glass original table 1 covered with a cover 102 and is irradiated with an illumination lamp 104. Light scanned by the lamp 104 is focused on a photosensitive surface of a photosensitive drum 108 through mirrors **105*a* and 105*b*, a zoom lens 106, and mirrors 105*c* and 105*d*. The photosensitive surface of the photosensitive drum 108 is cleaned with a blade cleaner 109 and is uniformly charged by a charger 101 to a predetermined potential. An electrostatic latent image of the original image is formed on this charged photosensitive drum surface. Alternatively, the photosensitive drum is charge-removed together with a light image by a secondary charger 11. Subsequently, the photosensitive surface is exposed uniformly by an exposure lamp 12** to form an electrostatic latent image of high contrast.

The latent image thus formed is developed by a developing unit 112 and is transferred by a transfer charger 114 onto a transfer sheet supplied from a cassette 113 by a pickup roller 15. At the transfer section, the developed image on the surface of the photosensitive drum 108 is transferred by applying corona discharge from the rear surface of the transfer sheet. The transfer sheet is exhausted from the transfer section and is supplied to a fixing unit 117 by convey rollers 115 and 116. The image on the transfer sheet is fixed. The transfer sheet is exhausted into a copy tray 118. After the transfer operation, residual toner remaining on the surface of the photosensitive drum 108 is cleaned by the blade cleaner 109 and the drum is prepared for the next copy cycle.

In this manner, the copy unit is an image processing apparatus wherein a latent image is formed on a photosensitive body by a light image, developed by a developing unit, and reproduced as an image on a transfer sheet. A leading edge sensor 119 is actuated by a cam 131 of an original table when the original table is moved to a predetermined position. A photosensor 121 measures the density of an original image.

An original image can be read by a photosensor and converted into an electrical signal, and a laser beam can be modulated by this signal A photosensitive drum is irradiated with the modulated beam to form a latent image thereon. Note that the embodiment can be applied to an original reader, a printer (recording apparatus) or the like.

Figure 2:
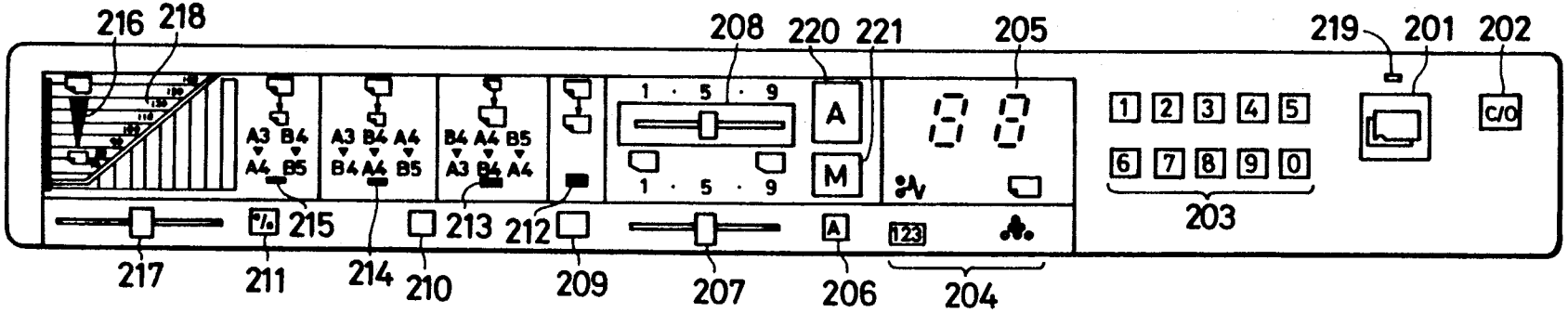
FIG. 2 is a view showing the outer appearance of an operation panel of an input/output control unit in the copy unit shown in FIG. 1.

FIG. 2 is a view showing the outer appearance of an operation panel 103 of an input/output control unit in the copy unit shown in FIG. 1.

Referring to FIG. 2, a copy start key 201 is used to start the copy operation and a clear/stop key 202 is used to clear the preset number of copies or to stop the copy operation. Ten keys 203 are used to set a desired number of copies. A display 204 displays various states of the copy unit including, jamming, no paper, toner replenishment, and control counter inspection. A display 205 displays the number of copies, magnification and abnormality. A key 206 can be used to select the automatic or manual copy density adjustment mode. A display 220 is turned on when the automatic density adjustment mode is selected, and a display 221 is turned on when the manual density adjustment mode is selected A copy density correction lever 208 is for correcting an optimal position of a copy density lever 207. A real size copy mode key 209 is depressed to select the real size copy mode, and a size change copy mode selection key 210 is used to select a desired size When a copy magnification display key 211 is depressed, the lower 2 digits of a selected size are displayed by the display 205. Fixed copy magnification mode displays 212 to 215 display the fixed copy magnification mode, and a stepless copy magnification mode display 216 displays the stepless copy magnification mode. When the key 210 is depressed, the display 212 is turned off while the display 213, 214, 215 or 216 is turned on to select a desired copy size mode. The size change copy mode selection key 210 can have an automatic repeating function to allow switching of the displays only while the key is depressed. A stepless size change lever 217 allows setting of a desired size of magnification. The magnification range is 65 to 142% of the original size. A magnification scale 218 corresponds to the position of the stepless size change lever 217. A main/wait display 219 is turned off in the wait mode and is turned on in the standby mode.

The display 220 is turned on when the automatic density adjustment mode is selected, and the display 221 is turned on when the manual density adjustment mode is selected.

Figure 3:
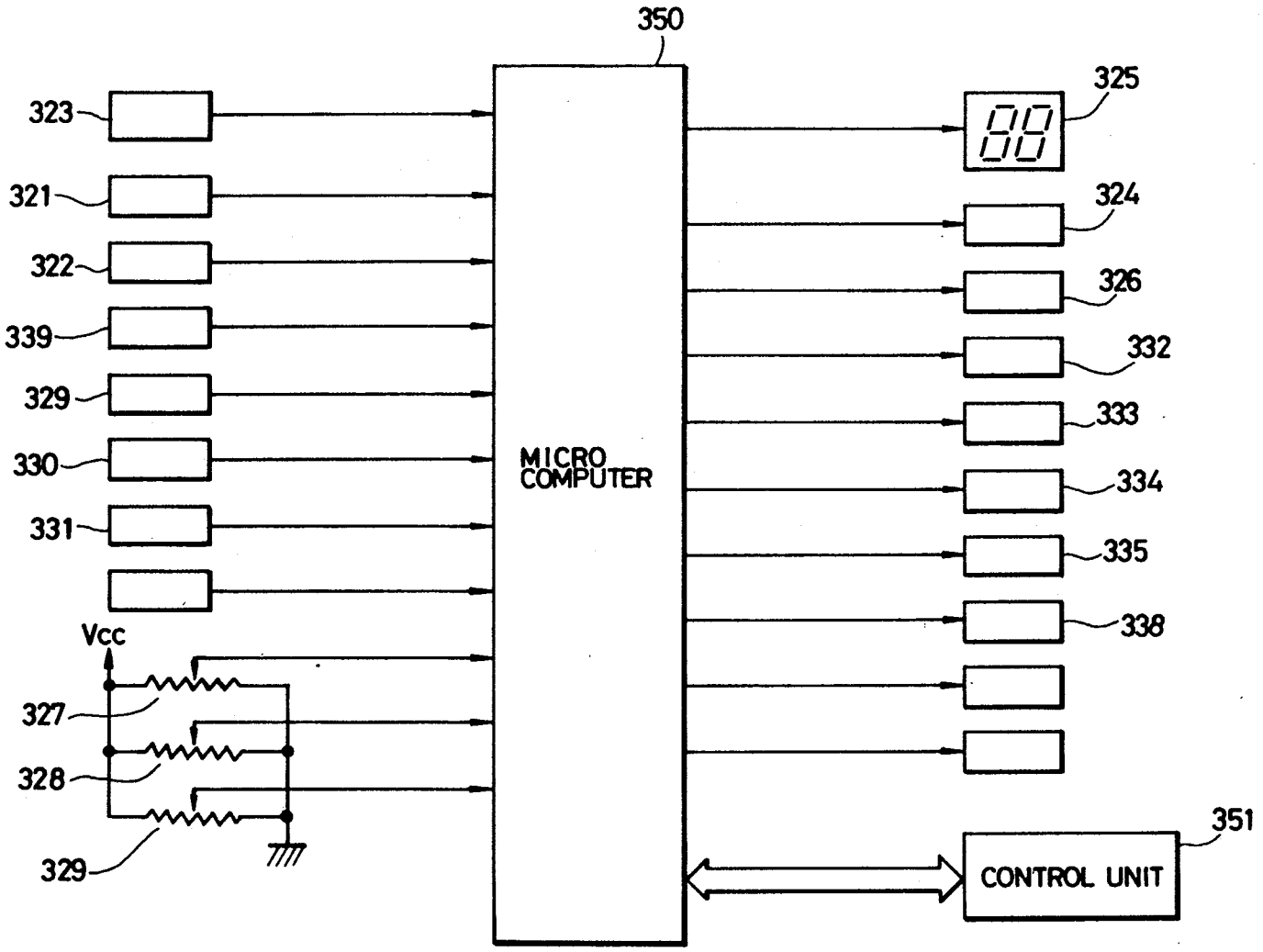
FIG. 3 is a block diagram of a control circuit of the input/output control unit in the copy unit shown in FIG. 1.

FIG. 3 is a block diagram of a control circuit of the input/output unit shown in FIG. 2. The same reference numerals as in FIG. 2 denote the same parts in FIG. 2, and a detailed description thereof is omitted Referring to FIG. 3, an input/output control unit 350 mainly comprises a micro computer 350. A control unit 351 controls the copy operation. The micro computer 350 receives input commands from the various keys 201 to 203, 209 to 211 and 206, and slide levers or VRs 207, 208 and 217. In response to these input commands, the micro computer 350 supplies signals to the displays 205, 26-1, 26-2, 212 to 215 and 218 and also supplies required signals to the control unit 351. The micro computer 350 also receives signals from the control unit 351 and turns on the display 204. The micro computer 350 has an analog-digital converter for converting analog signals from the slide levers 208 and 207 into digital signals.

Figure 4:
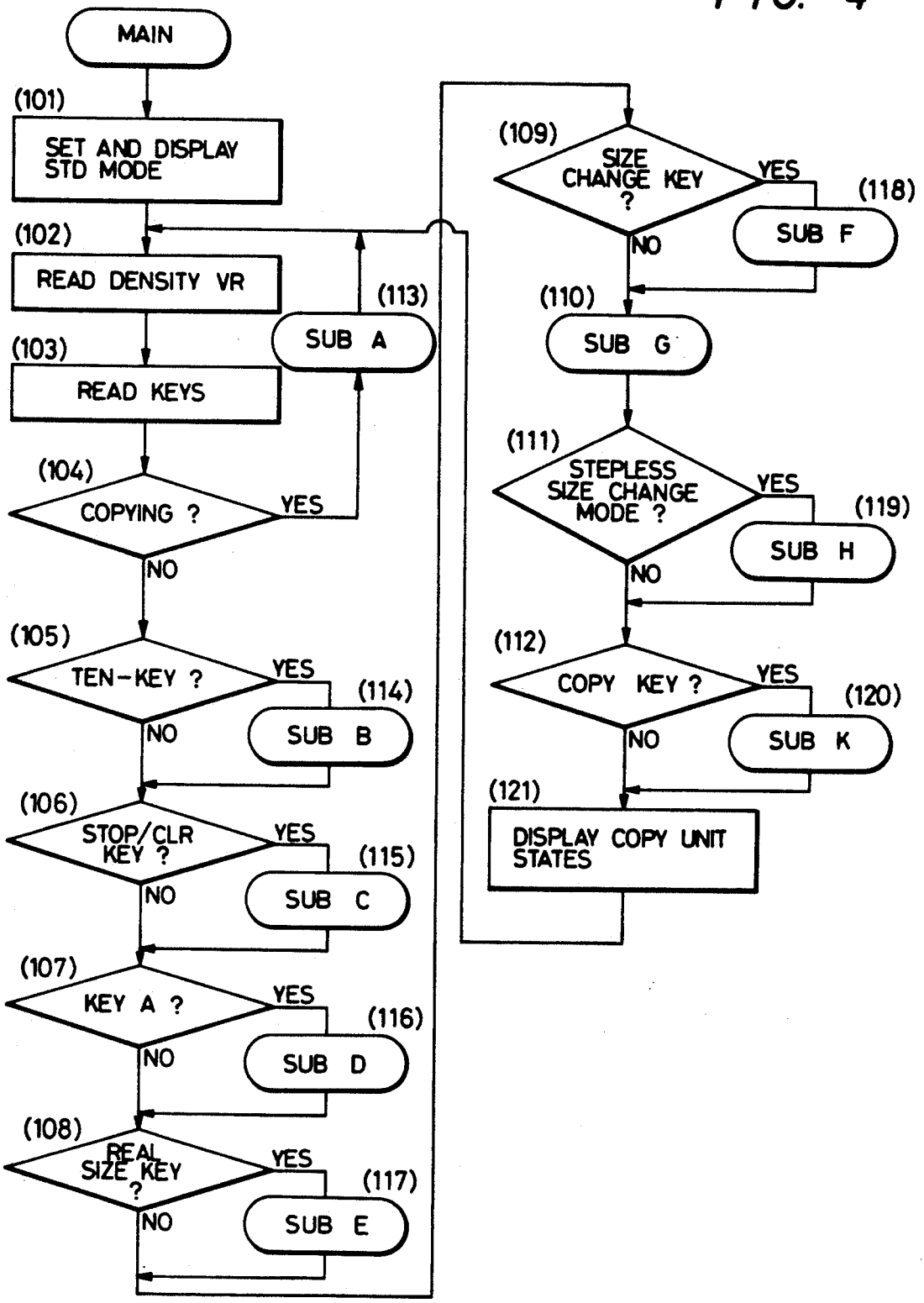
FIG. 4 is a control flow chart of the input/ output control unit.
Figure 5A:
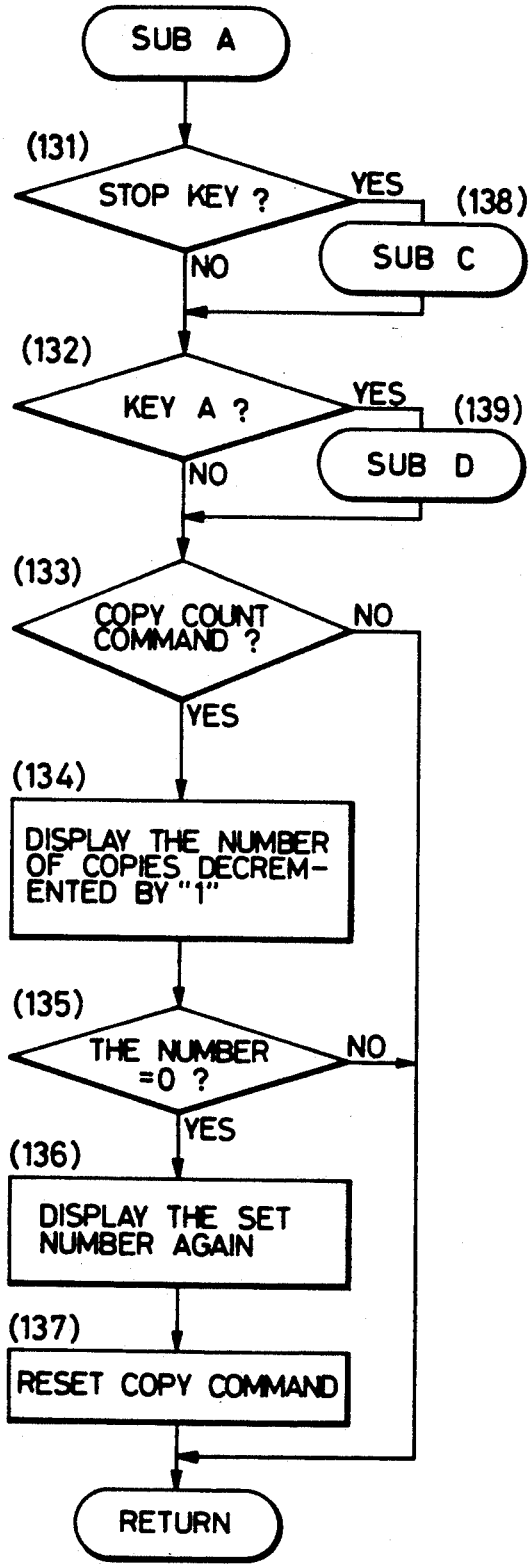
FIGS. 5A to 5I are control flow charts of subroutines in FIG. 4.
Figure 5B:
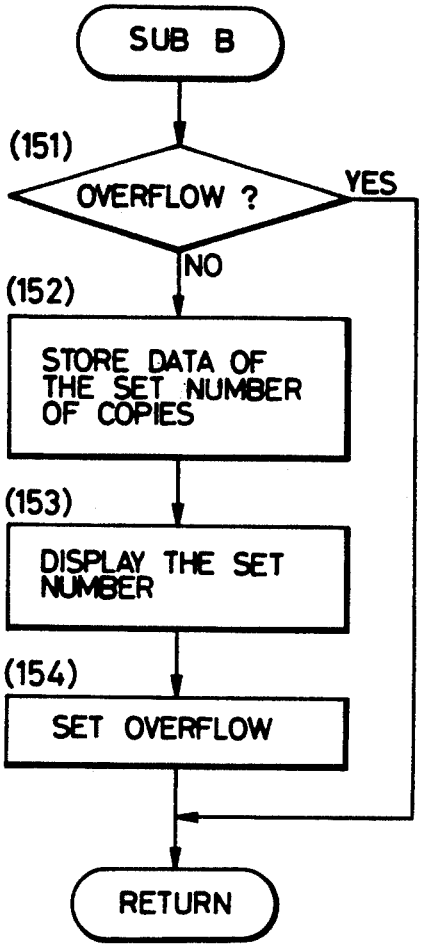
Figure 5C:
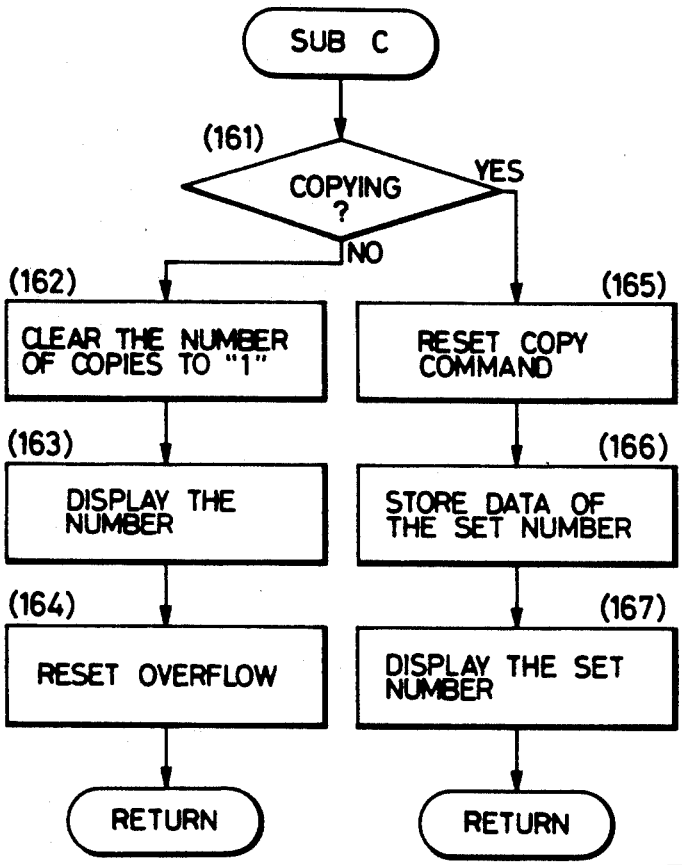
Figure 5E:
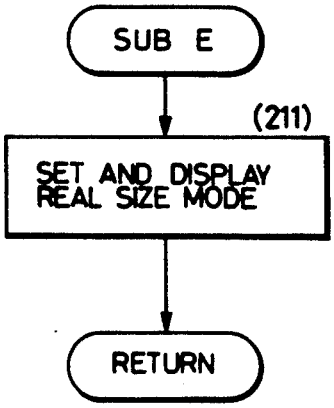
Figure 5I:
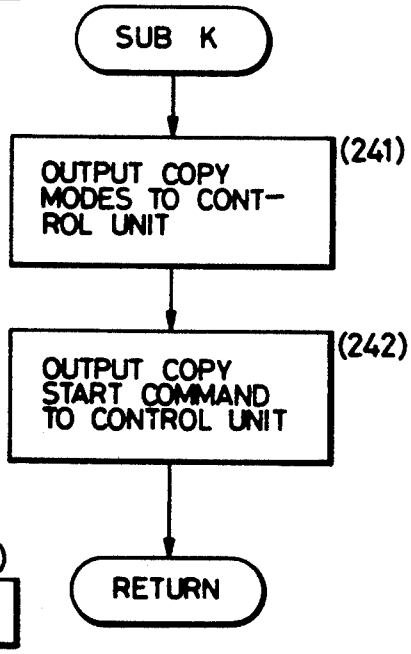
Figure 5D:
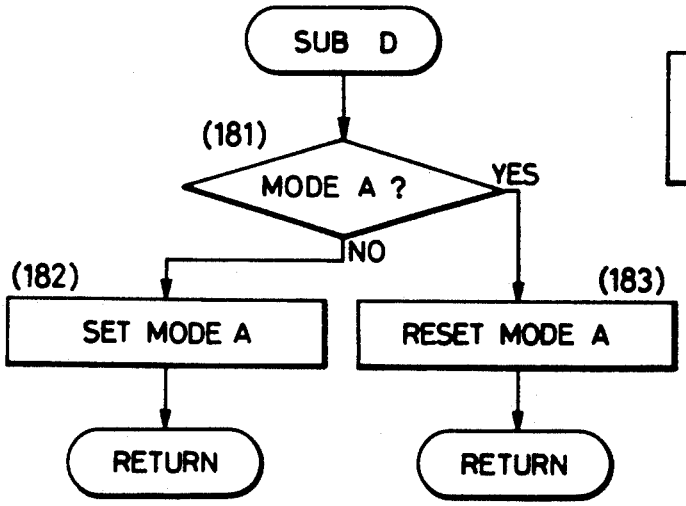
Figure 5F:
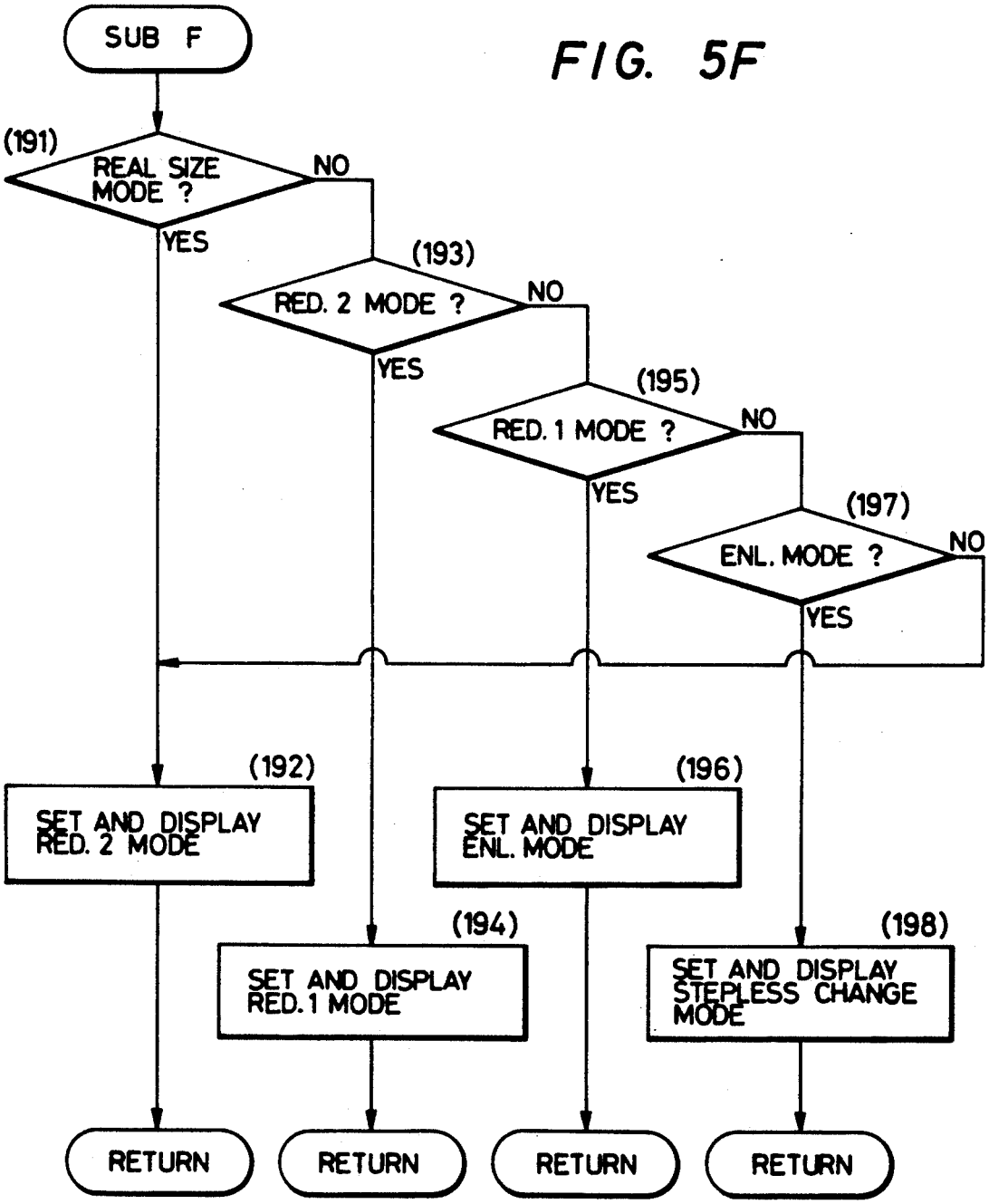

The operation of the input/output unit will be described mainly with reference to the operation of the micro computer 350 and to FIGS. 2 to 5. FIG. 4 is a flow chart of a control system of the input/output unit, and FIG. 5 is a flow chart of a subroutine in FIG. 4. The same reference numerals denote the same parts throughout these figures.

In the description to follow, numbers in brackets denote steps of corresponding numbers. When the power source is turned on, the standard mode is set (101). In this mode, "1" is indicated by the display 205, the automatic density adjustment mode and the real size copy mode are set, and the displays 26-1 and 212 are turned on. Inputs through the various keys of the operation panel are read in (103), and the depressed keys are discriminated (104) to (112) When setting of a set number of keys inputted by the ten keys 203 is detected (105), data of the set number of copies is set in a memory (152) and is indicated by the display 205 (153). Once the number of copies is set by the ten keys 203, any subsequent input through the ten keys 203 is ignored (151). An overflow is set by the clear/stop key 202 (164). When depression of the clear/stop key 202 is detected (106), whether or not the copy unit is in copy mode is discriminated in accordance with a signal from the control unit 351 for controlling the copy operation (161). When the copy unit is not in the copy mode, the data of the set number of copies is cleared to "1" and "1" is indicated by the display 205 (163). However, if the copy unit is in the copy mode, a copy command to the control unit 351 is reset (165). A copy stop command is generated, and the data of the set number of copies is initialized to an initial set number of copies (166) and the initial set number of copies is displayed (167). When the automatic/manual copy density adjustment mode selection key 206 is depressed (107), if the automatic copy density adjustment mode (A mode) is selected (181), it is reset in the A mode (183). When the A mode is not selected (181), the A mode is set (182). The mode data is supplied to the control unit 351.

When depression of the real size copy mode key 209 is detected (108), the real size mode is set and the real size copy mode display 212 is turned on (211). When depression of the size change key 210 is detected, the current mode is discriminated (191), (193), (195) and (197). When the real size mode is selected, the reduction 2 mode is set and the real size copy mode display 215 is turned on (192). When the reduction 2 mode is selected, the reduction 1 mode is set (194). When the reduction 1 is selected, the enlargement mode is set (196). When the enlargement mode is selected, the stepless size change mode is set (198). When the stepless size change mode is set, the reduction 2 mode is set (192). In the respective cases, the size change copy mode display 213, 214 and 215 and the size change copy mode display 218 is lit. Every time the size change key 210 is depressed, the size change mode is changed in the order of the reduction 2 mode, the reduction 1 mode, the enlargement mode, the stepless size change mode, the reduction 2 mode, and so on.

When it is detected that the copy magnification display key 211 is depressed (110), (212), data of the magnification corresponding to the selected copy mode is displayed at the display 205 (213). When the copy magnification display key 211 is not depressed, the data of the set number of copies is displayed at the display 205 (214).

When the copy mode is the stepless copy magnification mode (111), (119), the copy magnification set by the slide VR 217 is read in. The range of the magnification of stepless size change in this embodiment is 65 to 142%, as shown in FIG. 1. When the read value from the slide VR 217 is determined to be different from a previous value by a comparison (222), the data of the read copy magnification is set in a memory and the display of the display 205 is changed from the display of the set number of copies to the display of the copy magnification (223). At this time, a timer determining the data display time of the copy magnification is started (224). When there is no change in the read value from the slide VR 217, after the timer set in step 224 ends (225), the display content of the display 205 is changed to the data of the set number of copies (226). When the read value from the slide VR 217 changes again during the set time of the timer, display of the copy magnification changes in accordance with the read value and the timer is restarted (224). In this manner, when the slide VR 217 is moved in the stepless copy magnification mode and the copy magnification is changed, the content of the display 205 is automatically changed and the display content is held for a predetermined period of time. In this embodiment, the display content is held for about 2 seconds. However, since the slide VR 217 also serves as a display, 1 to 5 seconds is preferable for the holding time.

When depression of the copy start key 201 is detected (112), various copy modes are supplied to the control unit 351 (241), and a copy start command is supplied to the control unit 351 (242). In response to these output signals, the control unit 351 controls the copy operation. The state of the copy unit (not shown) is displayed by the display 204 in accordance with the signals from the control unit 351 (121).

When the copy operation is started and the copy mode is set (104), the SUB A routine is started. When depression of the stop key 202 is detected, the stop key processing routine (SUB C routine) is started. When the A key 206 is depressed, the A key processing routine (SUB D routine) is executed. When a copy count command signal from the control unit 351 is detected (133), a remainder obtained by subtracting "1" from the data of the set number of copies is displayed at the display 205 (134). When the data of the set number of copies becomes "0" (135), the data of the set number of copies is reset to the set number and displayed (136). The copy start command signal supplied to the control unit 351 is then reset (137), and the copy operation is stopped.

In this manner, during the copy operation, the stop key 202 and the A key 206 are constantly monitored to perform the above processing and to start a copy counter so as to stop the copy operation at a proper timing. When a change command in copy density is received (102), a corresponding signal is supplied to the control unit 351. A SUB G routine for detecting the display key 211 in the routine SUB A can be included in the SUB G routine. When the display key 211 is depressed, the copy magnification display is performed.

In this embodiment, the display 205 is a 2-digit display. Therefore, when the data of the copy magnification (%) is displayed by the display key 211 or the slide lever 217, the lower two digits of the data are displayed. The range of copy magnification in this case is 65 to 142% Therefore, even if only two lower digits are displayed, no actual problem occurs, and an advantage in terms of low cost can be obtained In the above embodiment, the copy magnification is displayed by a set number display However, this display may also serve as a display for displaying an abnormality or a message. Furthermore, various types of slide resistors can be replaced with elements which sequentially change outputs by slide-type impedances or slide levers.

Figure 6:
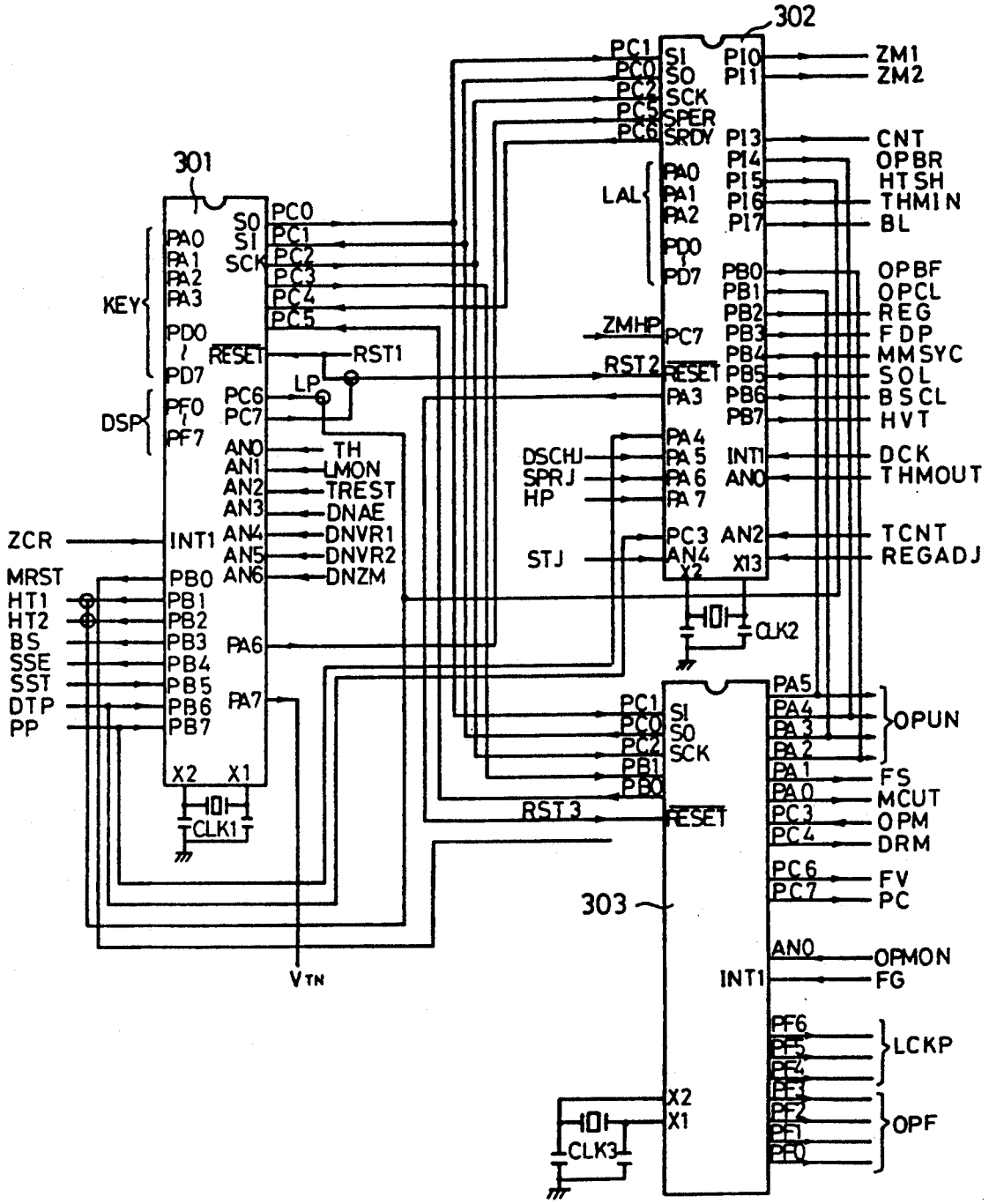
FIG. 6 is a circuit diagram of the control circuit.

FIG. 6 is a detailed circuit diagram of the control circuit shown in FIGS. 1 and 2.

In the control circuit shown in FIG. 6, one-chip micro computers (to be referred to as MPs hereinafter) 301 and 302 perform DC controller control. Particularly, the MP 301 performs signal processing such as key input or display of the operation panel, and the MP 302 performs the sequence control of the copy unit Another one-chip micro computer 303 performs DC motor control. The MP 301 corresponds to that of 350 in FIG. 3, and the MPs 302 and 303 are included in the control unit 351 in FIG. 3. Each MP has input or output ports PA0, PA1 and so on, a $\overline{\text{RESET}}$ terminal, and an interrupt input terminal INT1.

A description will briefly be made with reference to input or output signals at the respective ports of the MPs. These signals include a zero crossing detection signal ZCR, a main motor reset control signal MRST, a main heater control signal HT1, a sub heater control signal HT2, a density adjustment output signal BS for controlling a developing bias, a sorter set signal SSE, a sorter standby signal SST, an original leading edge detection signal DTP, a paper presence detection signal PP, an exposure lamp phase control signal LP, a thermistor heater temperature detection signal TH, an exposure lamp monitor signal LMON, a toner presence detection signal TREST, an original density detection signal DNAE, signals DNVR1 and DNVR2 representing the states of the manual copy density lever 207 and the copy density correction lever 208, a signal DNZM representing the state of the stepless size change lever, a signal KEY representing the state of a key input or mechanical adjustment, a signal DSP supplied to the displays, a residual toner detection power source $V_{TN}$, a signal ZMHP for the MP 302 as a home position detection signal of the zoom lens, an exhaust jam detection signal DSCHJ, a separation jam detection signal SPRJ, an original home position detection signal HP, a sorter jam detection signal STJ, signals ZM1 and ZM2 representing the position of the zoom lens, a copy number counter signal CNT, a signal OPBR for stopping the return movement of the optical system (original table), an ON/OFF control signal HTSH when an abnormality of the heater is detected, a signal THMIN for supplying a thermistor disconnection signal to the memory, a blank exposure control signal BL, a signal OPBF instructing a forward or backward movement of the optical system, an ON/OFF control signal OPCL for moving the optical system, a registration roller control signal REG, a feed paper timing control signal FDP, a signal MMSYC for controlling charge removal of the fan and the separation belt and precharge in synchronism with the main motor, a lower paper feed cassette control signal SOL, a developing bias ON/OFF control signal BSCL, a high-voltage power source control signal HVT, a drum clock DCK, a signal THMOUT for outputting a thermistor disconnection signal from the memory, a total counter abnormality detection signal TCNT, a registration timing adjustment signal REGADJ, an LED array control signal LAL, an abnormality diagnosis signal OPUN for the MP 303 for controlling the drive motor, brake, forward movement, backward movement, and ON/OFF state of the optical system, a magnification reference frequency signal FS, a motor abnormality stop signal MCUT, an optical motor control reference signal OPM for generating a pulse speed control signal FV, a drive motor control signal DRM, a pulse speed control signal FV of a predetermined width, a phase control signal PC, an optical motor control monitor signal OPMON, an optical motor encoder signal FG, a lock phase display signal LCKP, an optical motor filter switching signal OPF, reset signals RST1 to RST3 for the MPs 301 to 303, respectively, a serial communication input SI, a serial communication output SO, a serial communication clock SCK, a serial communication permission signal SPER, a serial communication reception signal SRDY, and reference clocks CLK1 to CLK3 of the MPs 301 to 303, respectively.

Another method of the size change operation will be described below.

In this method, even if a copy magnification is changed accidentally during the non-copy period, it can be corrected.

The operator first depresses the size change copy mode selection key 210 several times to select the position of the stepless copy magnification display 216 to set the stepless size change. At this time, a variable resistor of the stepless size change lever 217 (first setting means) is slid to freely select a copy magnification from the range of 65 to 142%. In the stepless copy magnification mode, the lower 2 digits of the magnification selected by the operator are displayed by the display 205. For example, when the operator selects a magnification of 125%, 25 is displayed. In the stepless copy magnification mode, when the copy operation is executed, the number of copies set by the operator are produced with a magnification selected by the operator. When paper sheets become short in supply during this copy operation, the copy operation is interrupted. Even if the operator accidentally slides the stepless size change lever 217 during replenishment of paper sheets, it can be returned to the original selection in this embodiment in the manner to be described below. Thus, the magnification set before movement of the stepless size change lever 217 is stored. When the copy operation is resumed after copy sheet replenishment or the like, the stored value is displayed at the display 205. On the other hand, if the operator actually wanted to change the magnification despite the first selection and moved the lever 217, the stored magnification can be cleared in accordance with the following conditions:

a. elapse of a 2 minute automatic clear time b. input signal of copy magnification display key 211 c. input signal from the size change mode selection key 210 and the real size copy mode key 209 (second setting means).

The method of clearing the stored magnification is not limited to the conditions a to c above, and other suitable means can be adopted.

Figure 7A:
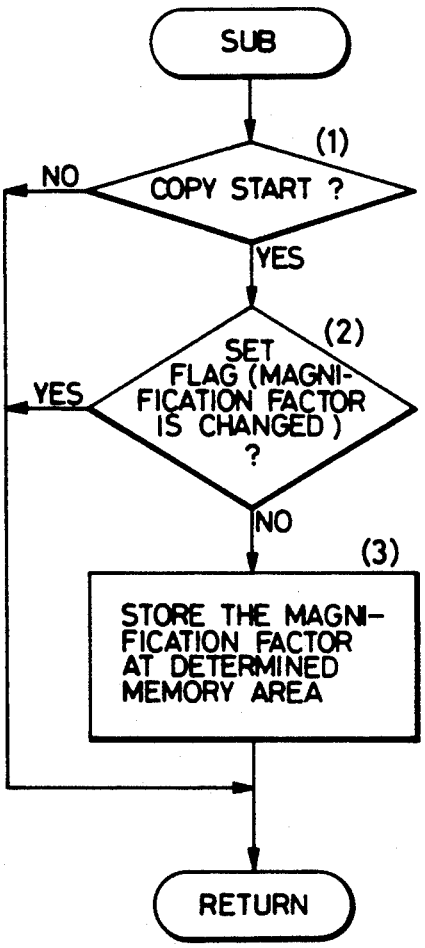
FIGS. 7A–7C, 8A–8C, 9, 10 11A, 11B, 12 and FIGS. 13A–13 D are control flow charts of size change.
Figure 7C:
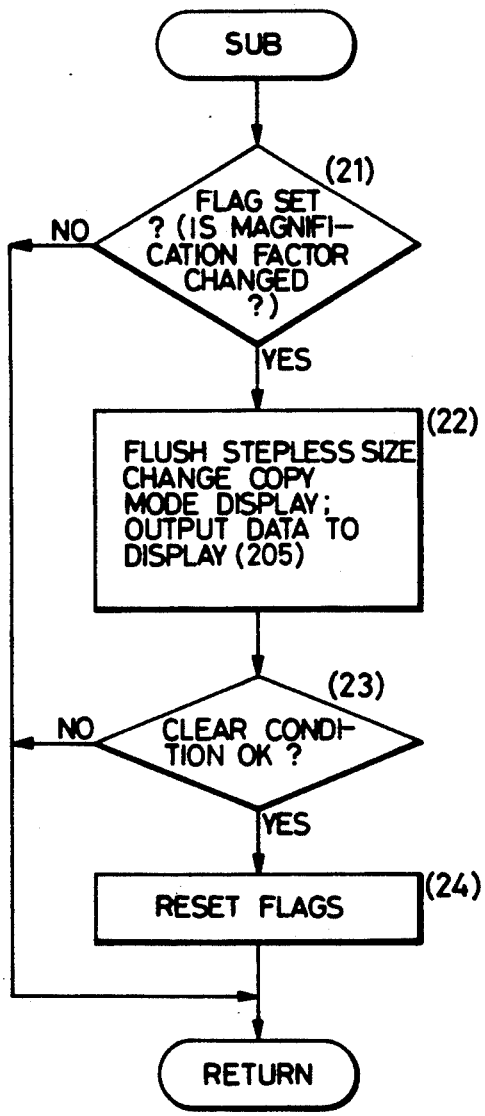
Figure 7B:
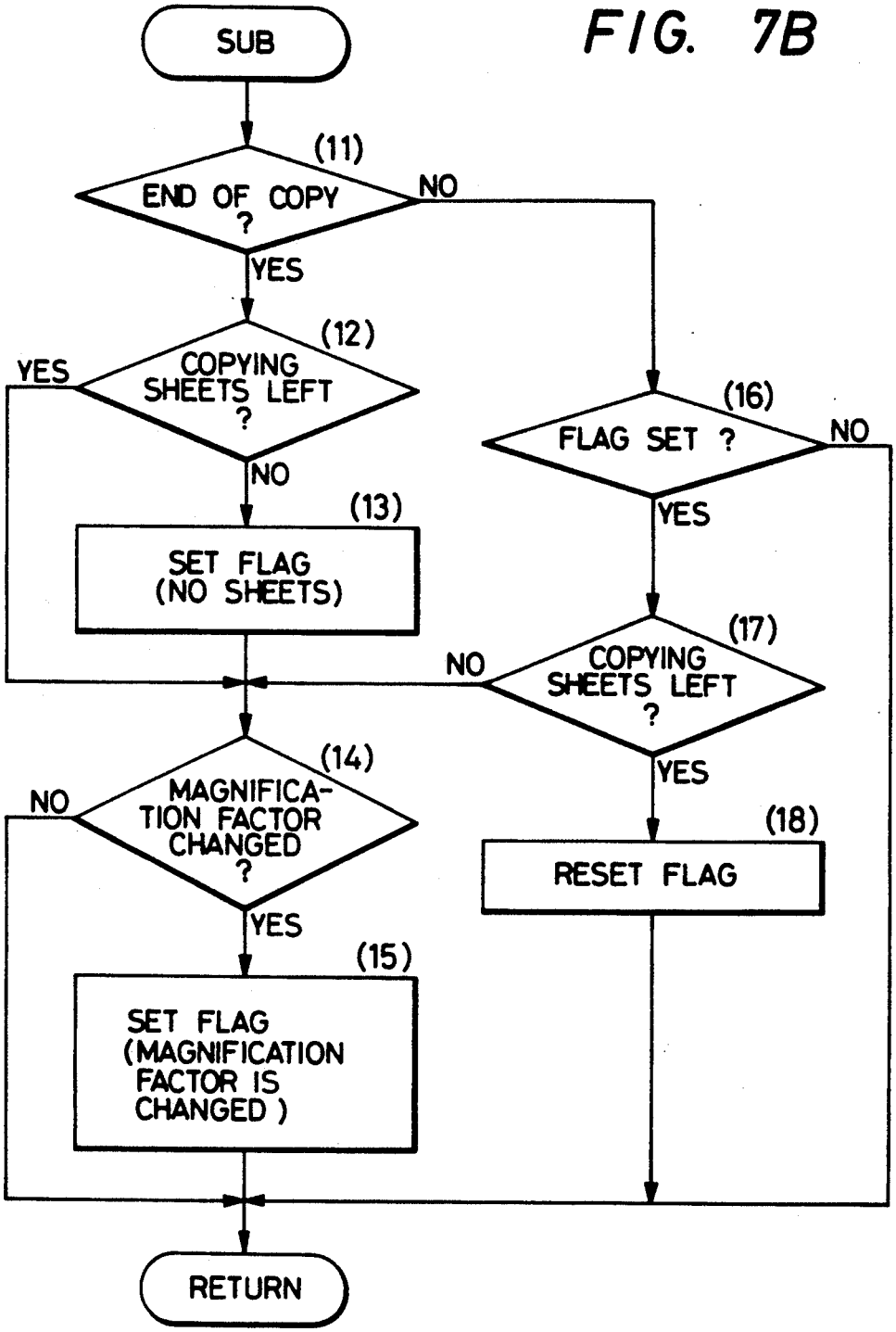

The control operation of the size change mode will be described with reference to the flow charts shown in FIGS. 7A to 7C. Each flow shown in FIGS. 7A to 7C is a sub routine called in response to a CALL command in the main program so as to allow execution of a desired program during execution of the main program. Note that numbers in brackets denote steps. Flags (magnification is changed) in the flow charts are flags which are reset when the magnification set at the copy start timing in the stepless copy magnification mode is changed before the copy sheet short supply state is released or the copy operation is completed.

In the flow shown in FIG. 7A, it is checked whether the copy operation is to be started (1). If YES, the flag is checked (2). If the flag is not set, the current magnification is set in a predetermined memory address (3). However, if NO in step (1) and YES in step (2), the flow returns to the main routine.

The flow shown in FIG. 7B is executed when shortage of copy sheets is detected

It is first checked if the copy operation has been completed (11). If YES in step (11), remaining copy sheets are detected (12). If NO in step (12), the no paper flag is set (13). The current magnification and the magnification stored in step (3) are compared. If they are different, the flag (magnification is changed) is set (14), (15). However, if YES in step (12), the flow jumps to step (14). If there is no difference between the two magnifications in step (14), the flow returns to the main routine. If the copy operation has not been completed in step (11), the set state of the no paper flag is checked. If the no paper flag is set, the remaining paper sheets are detected (16), (17). If the paper sheets are short in supply, the flow jumps to step (14). If YES in step (17), the no paper flag is reset and the flow returns to the main routine (18). If the no paper flag is not set in step (16), the flow immediately returns to the main routine.

The flow shown in FIG. 7C is executed when the flag (magnification is changed) is set.

The set state of the flag (magnification is changed) is checked (21). When the flag is not set, the flow immediately returns to the main routine. However, when the flag (magnification is changed) is set, the stepless copy magnification mode display 216 is flashed and data for display at the display 205 is transmitted (22). The clear conditions a to c described above are discriminated. If YES, the flag (magnification is changed) and the no paper flag are reset (24) and the flow returns to the main routine. However, if the clear conditions are not satisfied (23), the flow immediately returns to the main routine.

In the above embodiment, a specific state to be detected was shortage of paper sheets. However, it can be jam trouble, stop or interruption.

Still another example will be described with reference to FIG. 8. In this example, a set magnification is stored, and a change in the set magnification is displayed. Therefore, if the operator accidentally changes the set magnification, he can correct it. Therefore, a desired number of copies can be produced at a desired (enlarged or reduced) size.

During the execution of the copy operation, if the resistance of the variable resistor constituting the stepless size change lever 217 is not read during the copy operation, the set magnification will be different at the end of the copy operation from the original set magnification. If this is performed intentionally, no problem arises. However, the magnification is rarely changed during the copy operation. When the magnification is indeed changed during the copy operation, it is changed due to an erratic operation or negligence of the operator. In the copy operation in the stepless copy magnification mode, the magnification at the start of the copy operation is stored. It is then compared with the magnification setting of the variable resistor at the end of the copy operation. When the two magnifications are not the same, the stepless copy magnification mode display 216 shown in FIG. 2 is flashed and the stored magnification is displayed by the display 205. When the copy operation is resumed in this state, the copy operation is performed with the magnification stored before it was inadvertently changed. When the copy magnification display key 211 is depressed while the stepless copy magnification display 216 flashes, the display 216 stops flashing and the magnification stored by the variable resistor is displayed by the display 205. Then, the operator can correct the value of the variable resistor and return the magnification to the value before the inadvertent magnification change. The flashing of the stepless copy magnification mode display 216 can be released in accordance with the following conditions a to d (means for selecting the retained magnification or a magnification corresponding to a position of the variable resistor, e.g., a movable member):

a. depression of the copy magnification display key 211
b. elapse of a 2 minute automatic clear time
c. depression of the size change copy mode selection key 210 and the real size copy mode key 209
d. depression or any other key.

Figure 8A:
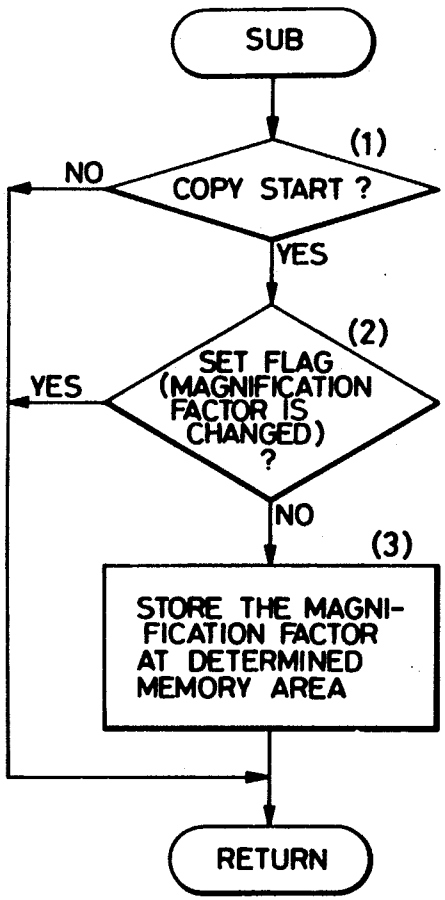
Figure 8B:
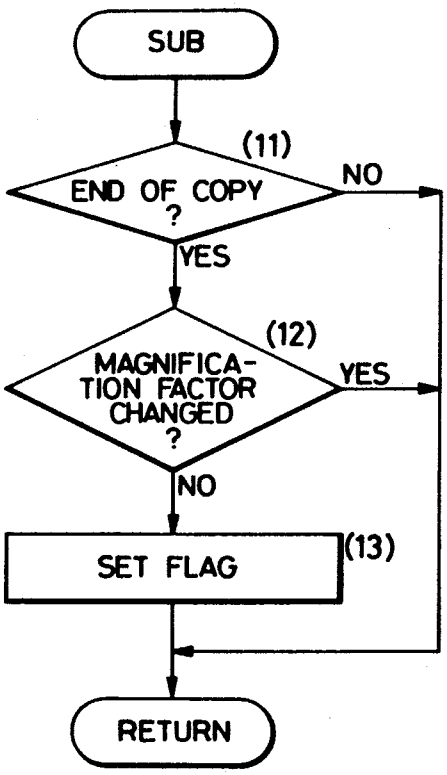
Figure 8C:
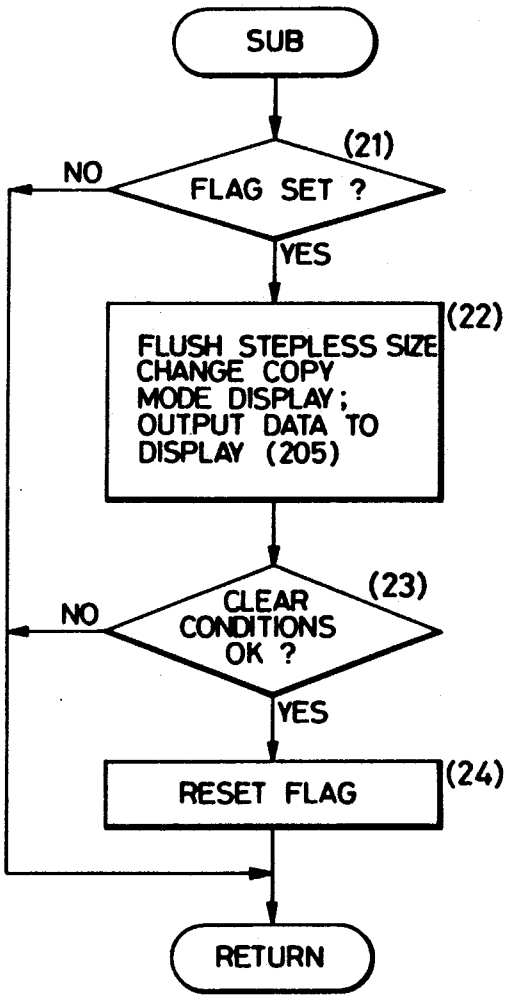

The control sequence of the size change copy will be described with reference to the flow charts shown in FIGS. 8A to 8C. The respective flows shown in FIGS. 8A to 8C are sub routines called in response to a CALL command of the main program and are executed as needed during execution of the main program. Note that numbers in brackets denote steps. Flags (magnification is changed) are flags which are set when the magnification at the start timing in the stepless copy magnification mode is changed before the state of paper shortage is released or the copy operation is ended.

In the flow shown in FIG. 8A, it is first checked if the copy operation is to be started (1). If YES in step (1), the flag (magnification is changed) is checked (2). If the flag is not set (2), the current magnification is stored at a predetermined memory address (3). If NO in step (1) and YES in step (2), the flow returns to the main routine.

The flow shown in FIG. 8B is executed every time the copy operation is executed.

It is checked if the copy operation has ended (11). If YES in step (11), the current magnification is compared with the magnification stored in step (3). When the two magnifications do not coincide, the flag (magnification is changed) is set and the flow returns to the main routine (12), (13). When NO in step (11) and YES in step (12), the flow returns to the main routine.

The flow shown in FIG. 8C is executed when the flag (magnification is changed) is set.

The set state of the flag (magnification is changed) is checked. If the flag is not set (21), the flow immediately returns to the main routine. When the flag is set, the stepless copy magnification mode display 216 is flashed, and data for displaying the magnification by the display 205 is transmitted (22). Then, it is checked if the conditions for releasing the flashing state of the stepless copy magnification mode display 216 are satisfied (23). If YES in step (23), the flag is reset and the flow returns to the main routine (24). When the conditions are not satisfied in step (23), the flow immediately returns to the main routine.

Still another example will be described. In this example, one of a fixed magnification and a desired magnification is selected. When a display is performed, a conventional display is used to reduce the cost and to improve the operability.

When the operator depresses the real size copy mode key 209 (second setting means) shown in FIG. 2, the fixed copy magnification mode display 212 is turned on, and the real size copy mode is selected. When the real size copy mode key 209 is turned off and the size change copy mode selection key 210 is depressed, the fixed copy magnification mode display 215 indicating 67% size reduction is turned on and size reduction of a magnification 67% is selected When the size change copy mode selection key 210 is repeatedly depressed or is depressed for a time period exceeding 0.5 sec, the fixed copy magnification mode displays 214 and 213, the stepless copy magnification mode display 216, and the fixed copy magnification mode display 215 corresponding to reduction copy of a magnification of 78%, enlargement copy of 120%, and reduction copy of a magnification of 67% are sequentially turned on. Then, the corresponding magnification is selected.

When the size change copy mode selection key 210 (second setting means) is operated, the stepless copy magnification mode display 216 is turned on and stepless size change is selected. In this case, a desired copy magnification can be set with the stepless size change lever 217. When the stepless size change lever 217 is used to change the magnification in this mode, the updated magnification is displayed by the display 205 when the change is detected. This display is kept displayed for 2 seconds after the magnification is changed.

The control sequence for size change copying will be described with reference to the flow charts shown in FIGS. 9, 10 and 11A and 11B. Each flow is a subroutine called in response to a CALL command in the main program and is executed as needed during the execution of the main program. Note that numbers in brackets denote steps. Data set in these flows means storage of a magnification or magnification display data in a magnification memory area of each display for displaying the selected magnification.

Figure 9:
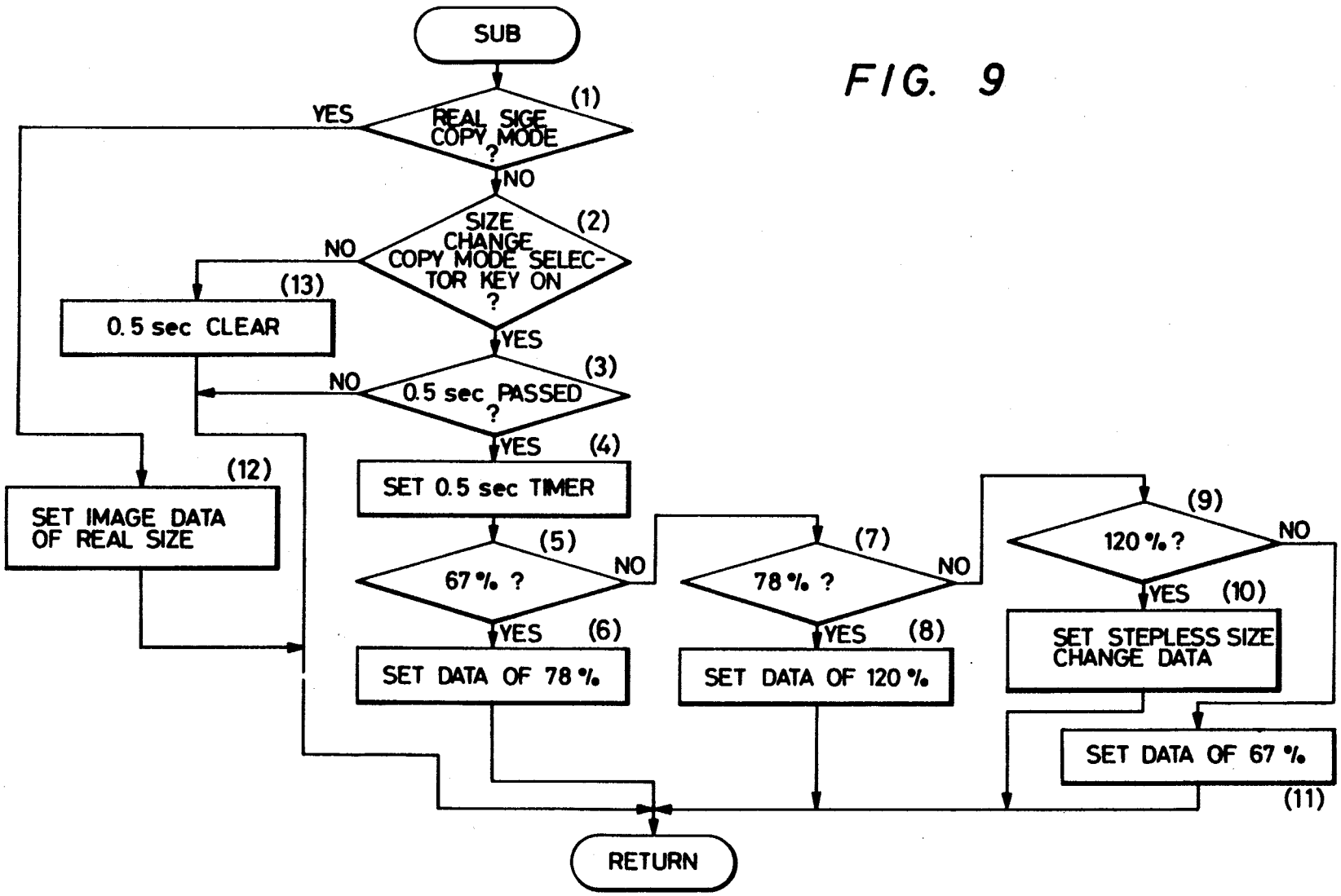

The flow shown in FIG. 9 is started when the operator sets the magnification. It is checked if the input key is the real size copy mode key 209 (1). If YES in step (1), image data of the real size is set and the flow returns to the main routine (12). If NO in step (1), the input key is the size change copy mode selection key 210. It is then checked if the ON state is continuing (2). If NO in step (2), the data is cleared after 0.5 sec (13), and the flow returns to the main routine. However, if YES in step (2), it is then checked if the ON state has continued for longer than 0.5 sec (3). If NO in step (3), the flow returns to the main routine. If YES in step (3), 0.5 sec is set in the timer (4). It is checked if the set magnification is 67%. If YES, reduction image data of a magnification of 78% is set and the flow returns to the main routine (5), (6). If NO in step (5), it is checked if the set magnification is 78%. If YES, the enlargement image data of a magnification of 120% is set, and the flow returns to the main routine (7), (8). If NO in step (7), it is checked if the set magnification is 120%. If YES, image data of stepless size change is set, and the flow returns to the main routine (9), (10). If NO in step (9), reduction image data of a magnification of 67% is set and the flow returns to the main routine.

Figure 10:
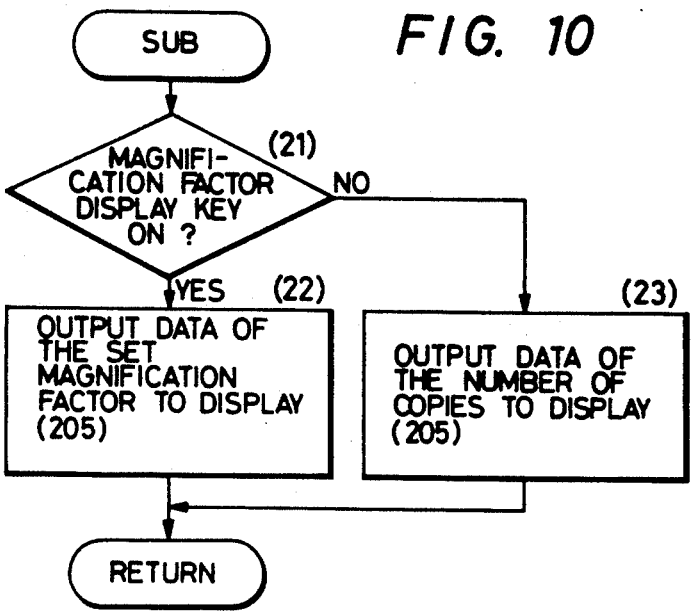

The flow shown in FIG. 10 is started while the stepless copy magnification mode display 216 is flashing. It is checked if the copy magnification display key 211 is depressed (21). If YES in step (21), display data for the set magnification at the start timing of the copy operation is supplied to the display 205 and the flow returns to the main routine (22). However, in NO in step (21), the data of the set number of copies is supplied to the display 205 and the flow returns to the main routine.

Figure 11A:
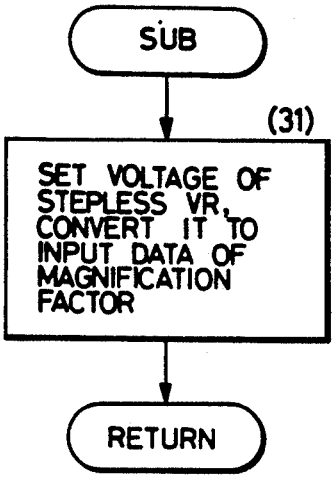

The flow shown in FIG. 11A is started when the size change copy mode selection key 210 is operated while the stepless copy magnification display 216 is turned on. A magnification (stepless volume voltage) is set in the variable resistor, and the set value is converted into magnification input data. The flow then returns to the main routine (31).

Figure 11B:
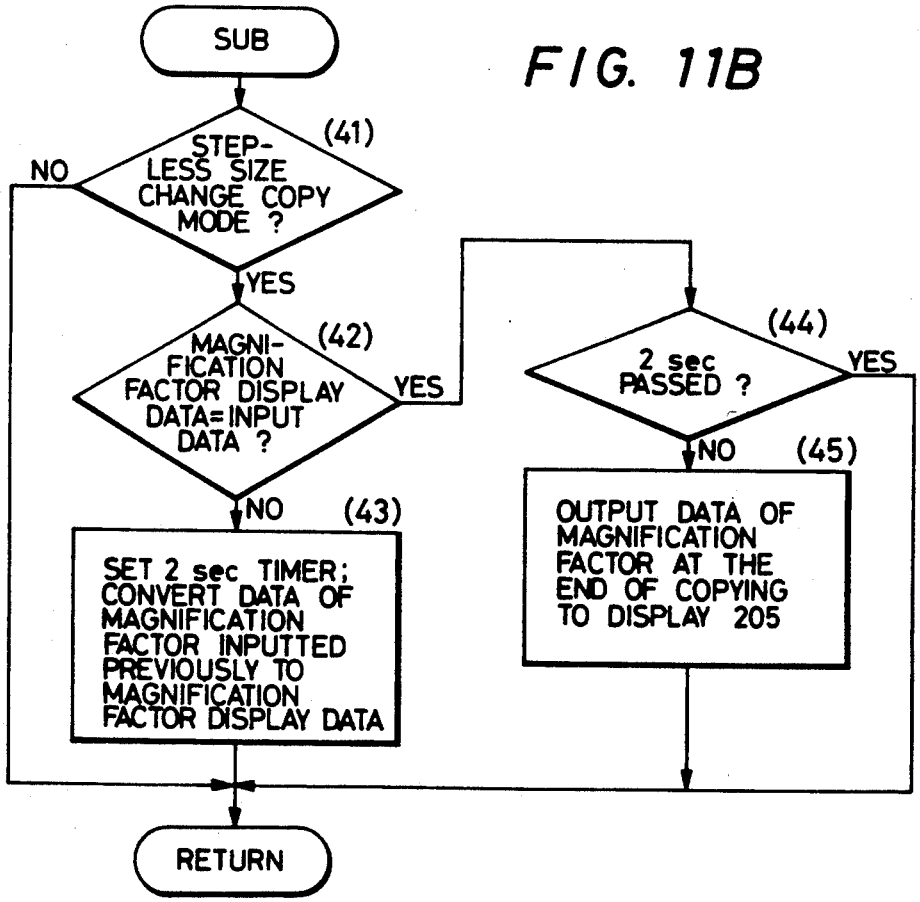

The flow shown in FIG. 11B is started when the size change copy mode selection key 210 is operated while the stepless copy magnification display 216 is ON. It is first checked if the magnification mode is the stepless copy magnification mode (41). If YES in step (41), it is checked if the magnification has changed during the copy operation by comparing the current magnification with the set magnification before the copy operation (42). When the magnification has changed, a 2-second timer is set, and the magnification input data before magnification change is converted into magnification display data. The flow then returns to the main routine (43). If it is determined that no magnification change has been made (42), the flow returns to the main routine after 2 seconds. When 2 seconds elapse in step 44, the magnification display data at the time of copy end is supplied to the display 205 and the flow returns to the main routine.

Still another example will be described below. In this example, the value of the leading edge margin which changes in accordance with a selected magnification is corrected thereby. Therefore, a margin of a predetermined width can be formed at the leading edge of a sheet irrespective of the selected magnification.

A method of calculating the sheet feed timing will be described with reference to FIG. 12.

Figure 12:
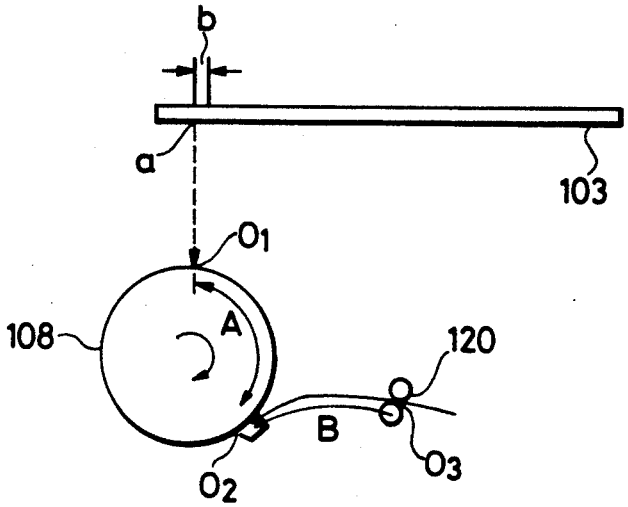

Referring to FIG. 12, the original panel 103, the drum 108 and the registration rollers 120 are of the same arrangement as that in FIG. 1. When a leading edge a of an original passes, an original leading edge detection signal DTP is supplied to the MP 301. A white board b is used for forming a leading edge margin. The drum 108 rotates as a speed v.An exposure point $O_1$ of the drum 108 has a distance A from a transfer point $O_2$ thereof. A transfer sheet leading edge $O_3$ of the registration rollers 120 has a distance B from a transfer point $O_2$. In general, $A-B>0$. Reference clocks T are clock pulses locked with the transfer sheet convey system and drum drive system. The sheet feed timing will be calculated for a case under the following conditions:

$A=50$ mm, $B=30$ mm, $b=2$ mm $T=1$ msec/P (pulse), $v=100$ mm/sec $A-B=20$ mm

When the copy operation is performed in the real size copy mode, since the timing difference of $A-B$ between the leading edge a of the document and the resupply of the transfer sheet is 20 mm, the timing difference is counted by the reference clocks T and the timing of resupply is determined in accordance with the count value. That is,:

$(A-B)/v=20/100=0.2$ sec $0.2/T=200P$

It will be seen from the above that after the leading edge a is detected by the original leading edge detection signal DTP, 200P reference clocks are counted by the counter means and the registration rollers 120 are driven.

When the copy operation is performed in the stepless copy magnification mode, the value of the leading edge margin b is changed in accordance with a selected magnification. For this reason, the following correction must be performed.

Although $A-B$ is a fixed value of 20 mm, the leading edge while portion of 2 mm depends on the set magnification and is influenced by a size change. The remaining 18 mm is a fixed value and is not influenced by a size change. Thus, when 2 mm in the real size copy mode is 20P in terms of pulse numbers the number of pulses for the magnification x% is given by:

$$20 \cdot x/100(P)$$

This represents the number of pulses corresponding to the sheet portion influenced by a size change. The 18 mm portion which is free from the influence of a size change corresponds to 180P. Therefore, when the sheet feed timing is corrected at $180+20 \cdot x/100$ (P) and the registration rollers 120 are driven to supply the sheet after counting this number of pulses, the leading edge margin b is obtained without dependence on the set magnification.

Timing control of sheet feed in the case of a size change will be described with reference to the flow charts shown in FIGS. 13A to 13D. Each flow is read out by a CALL command of the main program, and is executed as needed during execution of the main program. Note that numbers in brackets denote steps.

Figure 13A:
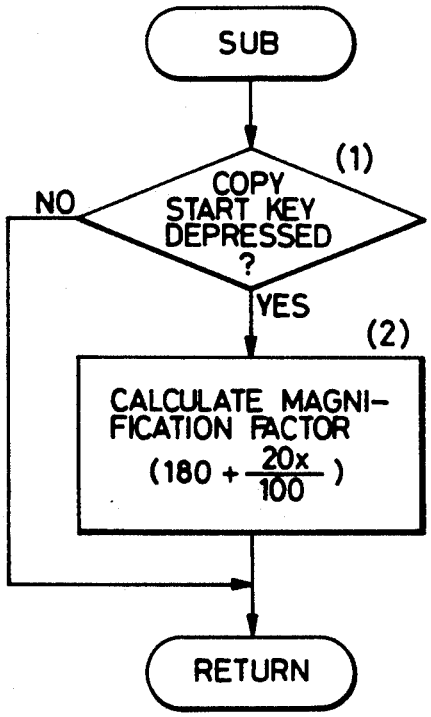

The flow shown in FIG. 13A is started when the stepless copy magnification mode display 216 is turned on. It is checked if the copy start key 201 is depressed. If YES, the drive start timing of the registration rollers 120 is calculated in accordance with a magnification set by the stepless size change lever 217, and the flow returns to the main routine (1), (2). If NO in step (1), the flow immediately returns to the main routine.

Figure 13B:
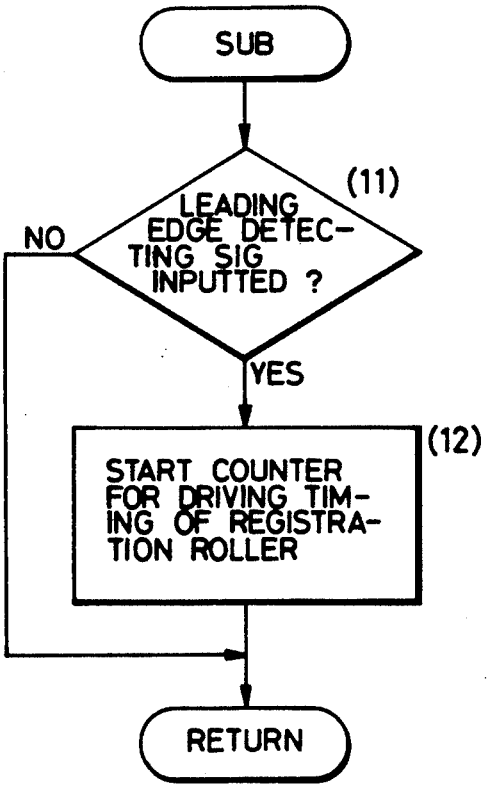

The flow shown in FIG. 13B is started after the flow shown in FIG. 13A is ended. It is first checked if the original leading edge detection signal DTP has been supplied to the MP 301. If YES, a counter for providing the drive timing of the registration rollers 120 is started (11), (12). If it is determined in step (11) that the leading edge detection signal DTP has not been supplied to the MP 301, the flow immediately returns to the main routine.

Figure 13D:
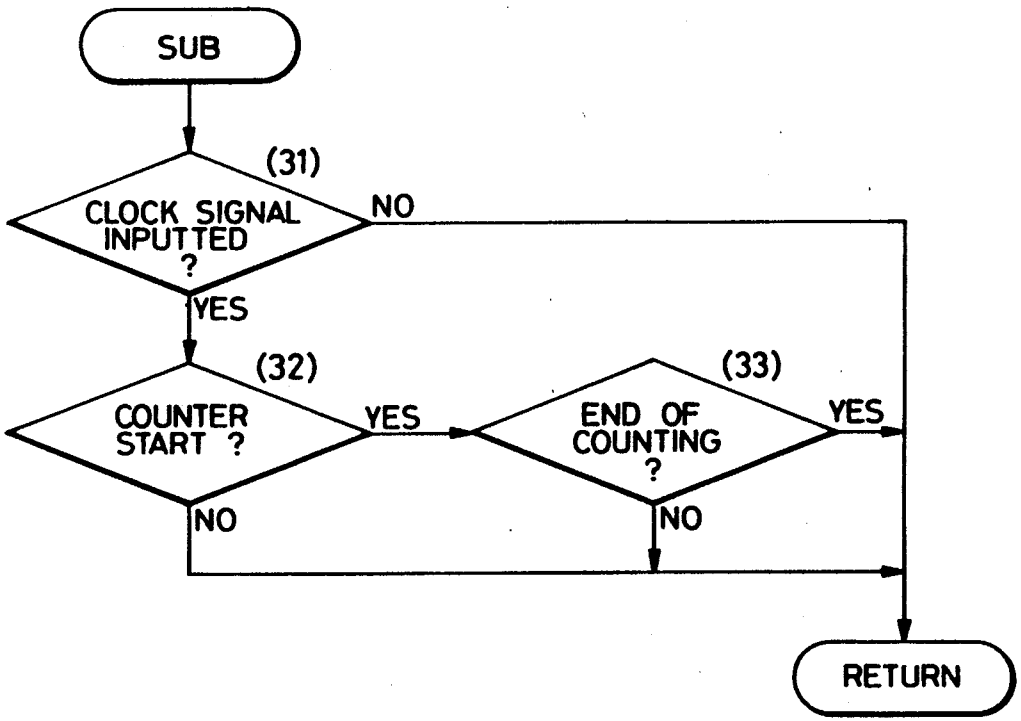
Figure 13C:
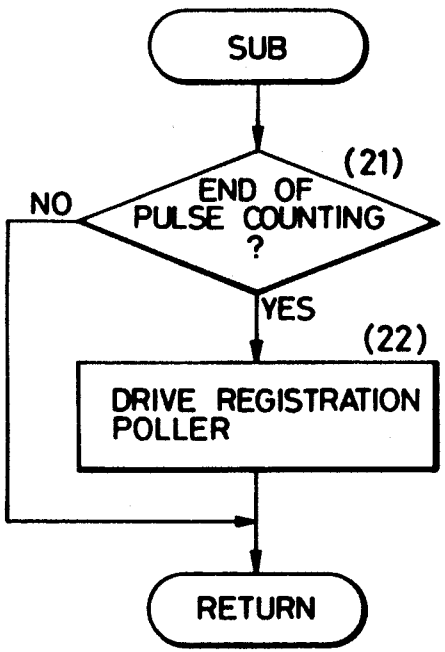

The flow shown in FIG. 13C is started after the flow shown in FIG. 13B is ended. It is checked if the counter started in step (12) has counted the number of pulses determined in step (2) (21). If the pulse counting has been completed, the registration rollers 120 are driven (22), and the flow returns to the main routine. If the counting is not completed (21), the flow immediately returns to the main routine.

The flow shown in FIG. 13D is started during the operation of the transfer sheet drive system and the drum drive system. It is checked if the clock signals generated during the operation of the drum drive system have been supplied to the MP 301 (31). If YES in step (31), it is checked if the counter for providing the drive timing of the registration rollers 120 has been started (32). If YES in step (32), it is checked if the number of pulses determined in step (2) have been counted (33). If YES in step (33), the flow returns to the main routine. However, if NO in steps (31), (32) and (33), the flow immediately returns to the main routine.

Control operation of the zoom lens for stepless size change will be described below.

Figure 14:
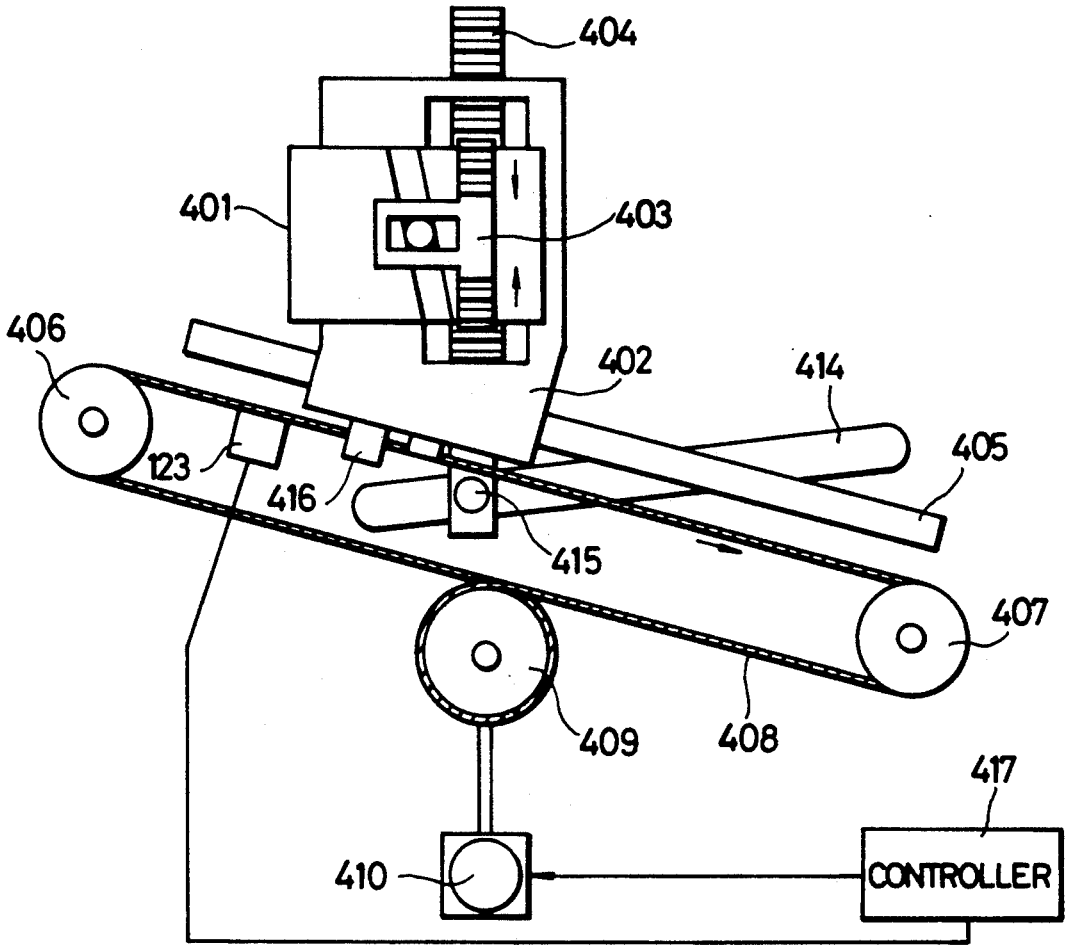
FIGS. 14 and 15 are views showing lens movement.

FIG. 14 is a view showing the main part of the arrangement associated with this control operation. A zoom lens 401 is mounted on a lens mount 402. A pinion 403 meshes with a rack 404. When the rack 404 is moved vertically, the pinion 403 meshing therewith is rotated to rotate the zoom lens 401 and to change the magnification. A rail 405 guides the lens mount 402. A wire 408 is looped around pulleys 406 and 407. The lens mount 402 is fixed to the wire 408. Thus, as the wire 408 is moved, the lens mount 402 is moved on the rail 405. The wire 408 is driven by driving the pulley 409 having the wire 408 wound thereon by a stepping motor 410 in the forward or reverse direction. Details are shown in FIG. 15.

Figure 15:
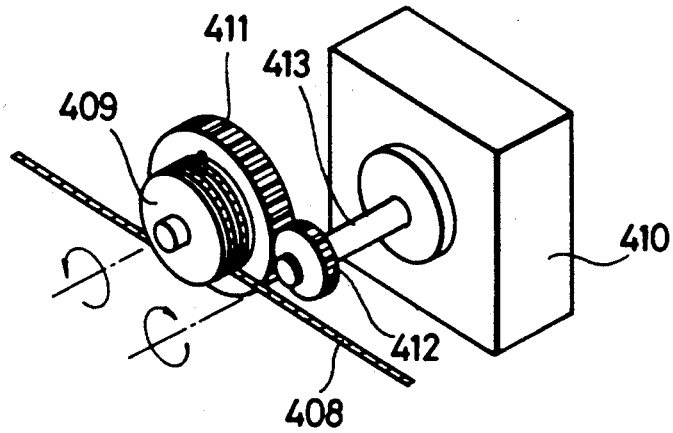

Referring to FIG. 15, a gear 411 is arranged integrally with the pulley 408. A small gear 412 meshes with the gear 411 and is fixed on a motor shaft 413. When the stepping motor 410 is rotated in the forward or reverse direction, the gear 411 is rotated through the gear 412, the pulley 409 is rotated, and one side of the wire 408 is wound while the other side is supplied. Thus, the wire 408 is moved around the pulleys 406 and 407, and the lens mount 402 is moved.

Referring to FIG. 14, a pin 415 of the rack 404 slidably engages with a rack groove 414. Therefore, when the wire 408 is moved in the direction indicated by the arrow, the lens mount 402 is also moved in the same direction. At this time, since the rack groove 414 has gradually moved upward, the pin 415 is also moved upward and the rack 404 is gradually pushed upward. Therefore, the zoom lens 401 is pivoted through the pinion 403. In this manner, by pivotal movement of the stepping motor 410, the lens mount 402 is moved and positioned at a position corresponding to a desired magnification, so that the desired magnification of the zoom lens 401 is obtained. A signal plate 416 is mounted on the lens mount 402. When a power source switch 122 is turned on, the stepping motor 410 moves the signal plate 416 until it shields the optical axis of a home position sensor 123. When the zoom lens 401 reaches the home position, the rotating direction of the stepping motor 410 is changed to the forward direction. When the signal plate 416 moves for a distance corresponding to a predetermined number of pulses from the position at which it is separated from the home position sensor 123, the stepping motor is stopped (the zoom lens 401 is at the position corresponding to the real size). The number of pulses applied to the stepping motor 410 (position of the zoom lens 401) is stored in a MP of a DC controller 417. When the zoom lens 401 must be moved, a number of pulses corresponding to the moving distance of the zoom lens 401 are generated and the zoom lens 401 is moved thereby.

When the zoom lens 401 is moved in the enlarging direction (a change from the reduction mode to the real size mode), the stepping motor 410 is rotated in the reverse direction first. After the passing the position corresponding to the selected magnification, the rotating direction of the motor is changed to the forward direction and the motor is stopped at a predetermined position. This is to stabilize the stop position of the zoom lens 401 by stopping the zoom lens 401 during the forward rotation of the stepping motor 410.

Figure 17:
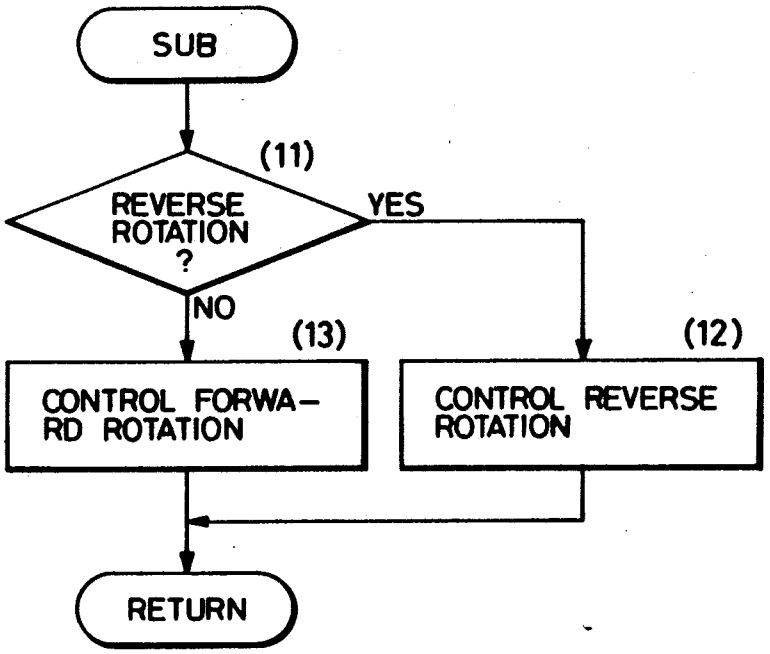
FIGS. 16 to 18 are control flow charts of lens movement.
Figure 16:
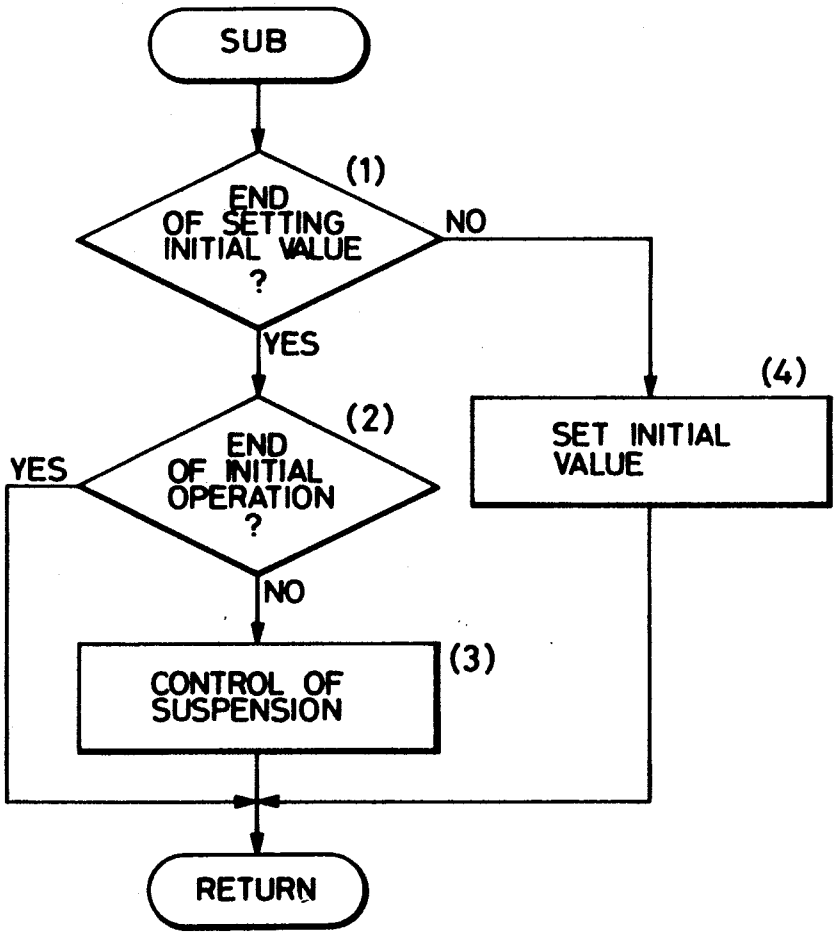
Figure 5H:
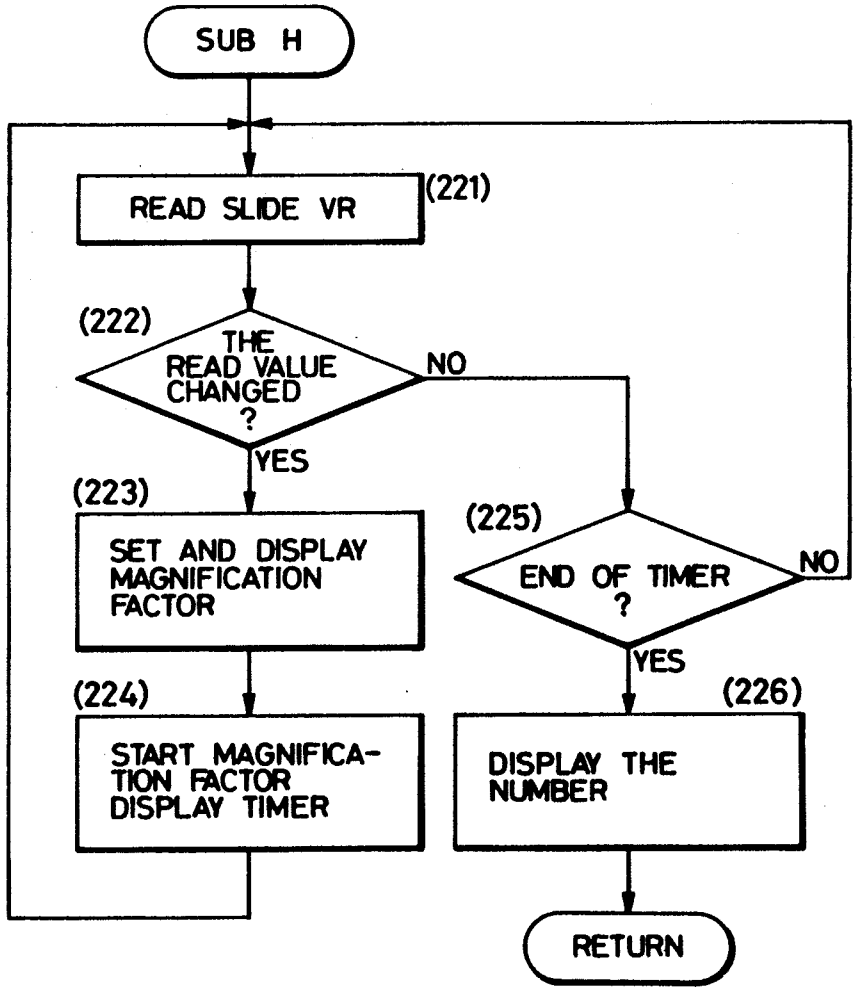
Figure 5G:
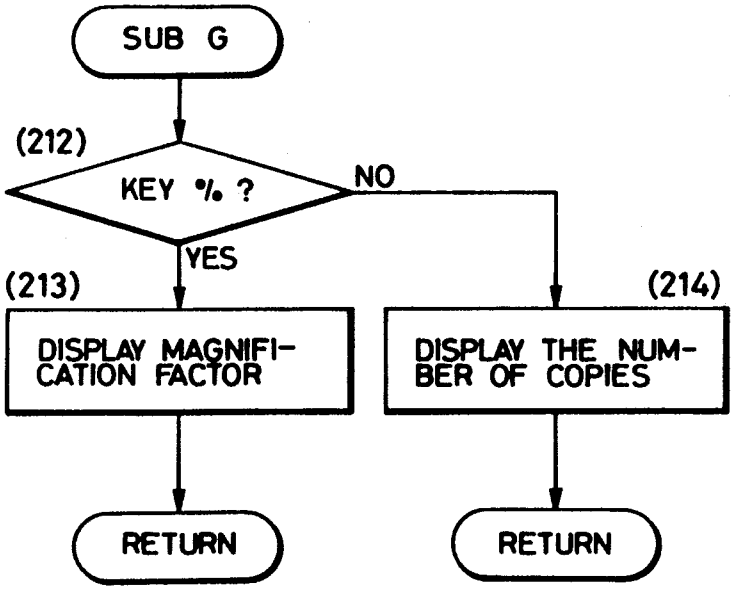
Figure 18:
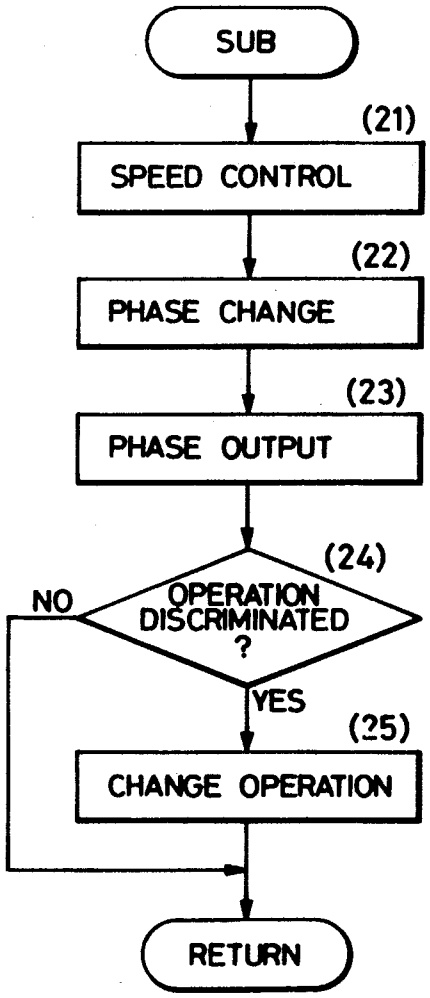

FIG. 16, 17 and 18 show flow charts for explaining the mode of operation of the embodiment according to the present invention. Each flow is read out in response to a CALL command in the main program and is executed as needed. Numbers in brackets represent steps.

The flow shown in FIG. 16 is stated when a power source switch 122 is turned on. It is checked if the initial value fore returning the zoom lens 401 to the home position is set (1). If YES in step (1), the zoom lens 401 is stopped at the real size position and whether the initialization is completed (2) is checked. In NO in step (2), the stop control is executed (3), and the flow returns to the main routine. If NO in step (1), the initial value is set (4), and the flow returns to the main routine. When the power source switch 122 is turned on, the zoom lens 401 is moved to the home position.

The flow shown n FIG. 17 is started while the stepless copy magnification mode display 216 is turned on. When the stop position of the zoom lens 401 must be changed by means of the stepless size change lever 217, it is checked if the pulley 409 must be reversed (11). If YES in step (2), the reverse control is performed (12), and the flow returns to the main routine. If NO in step (11), the pulley 409 is rotated in the forward direction (13), and the flow returns to the main routine.

The flow shown in FIG. 18 is started when the stepping motor 410 is driven. Speed control is performed in order to change the position of the zoom lens 401 in accordance with the set magnification (21). When the set magnification must be changed and the stop direction of the zoom lens 401 is different from the current direction, phase change is performed (22). In order to actuate the drive system in accordance with the phase change, a phase output is produced (23). It is checked if the zoom lens 401 has reached the position corresponding to the selected magnification (24). If YES in step (24), the moving direction of the zoom lens 401 is changed and the zoom lens 401 is stopped at the position corresponding to the magnification (25). If NO in step (24), the flow returns to the main routine.

In this example, the zoom lens is driven by the stepping motor, and the drive information corresponding to the distance between the stop position of the zoom lens and the zoom lens position corresponding to the magnification is stored. Therefore, the zoom lens can be reliably moved in accordance with continuously updated magnification. The arrangement can be rendered compact in size.

An example of a switching operation for density adjustment will be described with reference to the accompanying drawings.

In this example, automatic density adjustment and manual density adjustment can be switched as needed.

When the automatic/manual copy density adjustment switching key 206 is depressed in FIG. 2, the automatic density adjustment mode display 220 is turned on or off.

When the automatic density adjustment mode display 220 is ON, the automatic density adjustment mode is selected. When the manual density adjustment mode display 221 is OFF, the manual density adjustment mode display 221 is turned on to indicate that the manual density adjustment mode is selected. In the manual density adjustment mode, the density is manually adjusted by means of the copy density lever 207. A density level determined in each of the manual and automatic density adjustment modes is supplied to a bias output unit B (to be described later) as a pulse width level of a density adjustment output signal BS of the MP 301 shown in FIG. 3. In the manual density adjustment mode, the potential of the copy density lever 207 is read in as a signal DNVR1 from the A/D input terminal of the MP and a pulse width corresponding to the potential level is determined. In the automatic density adjustment mode, from the input timing of the original leading edge detection signal DTP, a signal DNAE is supplied to the A/D input terminal as the original density detection input of the MP 301 shown in FIG. 3 so as to determine the light amount incident on the photosensor 121 of the size change zoom lens 106. A pulse width corresponding to this light amount is calculated. This control is constantly performed by the MP. The pulse width corresponding to the selected mode of the automatic/-manual copy density adjustment switching key 206 is produced as the density adjustment signal BS.

Light amount detection in the automatic density adjustment mode will be described below.

Figure 19:
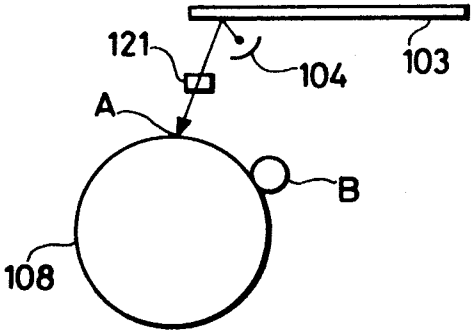
FIG. 19 is a representation for explaining density measurement.

FIG. 19 is a view showing a light amount detection mechanism, and the same reference numerals as in FIG. 1 denote the same parts in FIG. 19.

An exposure point A is on the drum 108. A bias output unit B is for adjusting the toner density. The bias output unit B changes the bias in accordance with the exposure density and determines the density. The original set on the operation panel 103 is exposed by the lamp 104. The light reflected from the original is received by the photosensor 121, and a toner density for transfer on the drum 108 is adjusted in accordance with the received light amount by changing the bias from the bias output unit B.

Figure 20A:
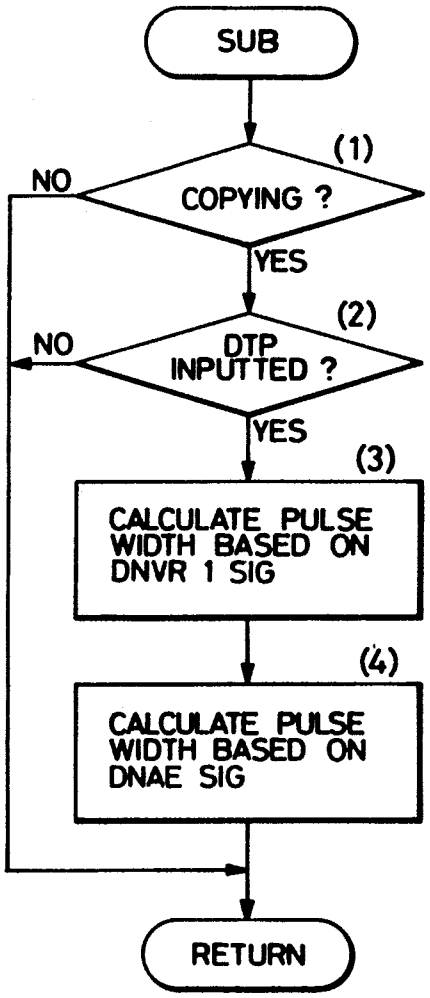
FIGS. 20A, 20B and 22 are density measurement flow charts.
Figure 20B:
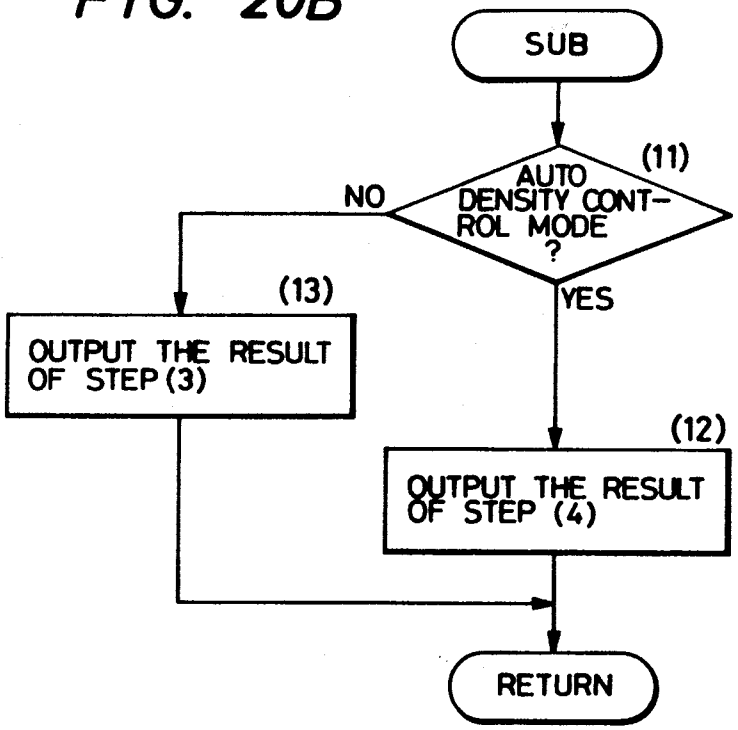

Optimal density control in the automatic density adjustment mode will be described with reference to the flow charts shown in FIGS. 20A and 20B. The flows in FIGS. 20A and 20B are called in response to a CALL command in the main program, and are executed as needed. Note that numbers in brackets denote steps.

The flow shown in FIG. 20A is started in the automatic density adjustment mode. It is checked if the copy operation is currently performed (1). If YES, it is checked if the original leading edge detection signal DTP is received (2). If YES in step (2), the pulse width corresponding to the potential level is calculated in accordance with the signal DNVR1 representing the potential of the copy density lever 207 (3). Furthermore, the pulse width corresponding to the light amount is calculated in accordance with the signal DNAE representing the original density detection input (4), and the flow returns to the main routine. If NO in step (1) or (2), the flow immediately returns to the main routine.

The flow shown in FIG. 20B is started when the copy operation is completed. It is first checked if the current mode is the automatic density adjustment mode (11). If YES in step (11), the pulse width calculated in step (4) is produced (12), and the flow returns to the main routine. However, if NO in step (11), the pulse width calculated in step (3) is produced (13), and the flow returns to the main routine.

Still another example will be described wherein an abnormality of the apparatus is detected by means of an original density detection sensor.

When the power source switch 122 shown in FIG. 1 is turned on, the temperature control inside the fixing unit 117 is started. When the fixing unit 117 reaches a predetermined temperature, warming-up is completed, and the copy operation can be started. In this copy wait state, the lamp 104 is OFF: and a signal of HIGH level (4 to 5 V) is applied to the photosensor 121 (normal state). When a voltage of LOW level (4 V or lower) is applied to the photosensor 121 while the lamp 104 is OFF (abnormality), the photosensor 121 could be defective or a driver for the lamp 104 may have caused trouble. The discrimination result of the HIGH or LOW level of the voltage level is displayed as the presence/absence of trouble by the display 205. This information is transmitted from the MP 301 to the MP 303. The driver of the lamp 104 is controlled by the ON/-OFF control signal HTSH from the MP 303.

Figure 21:
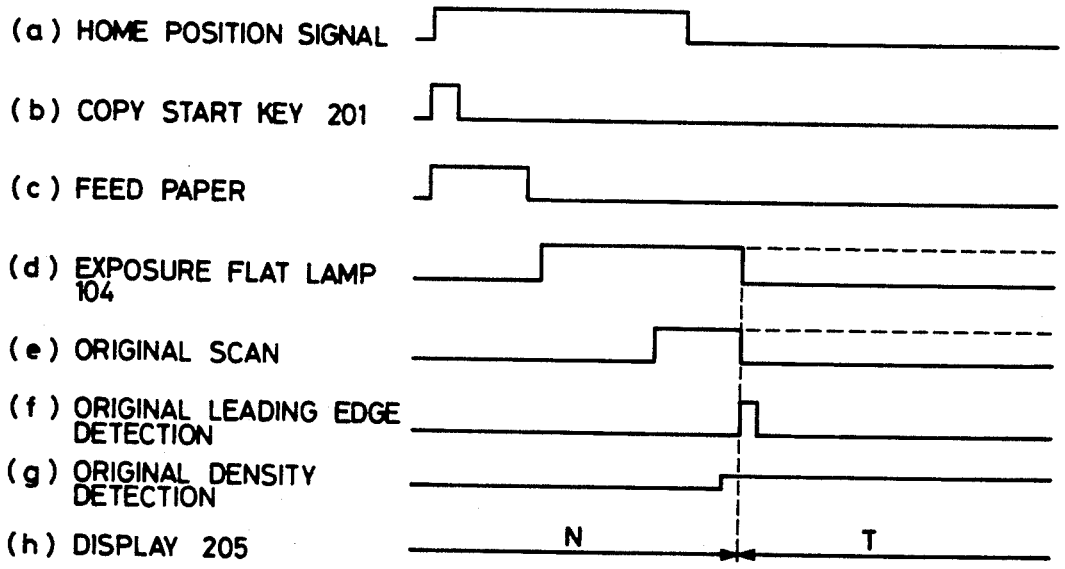
FIG. 21 is a timing chart for density measurement.

A control operation when the copy start key 201 is depressed in the copy wait state after the warming-up and the copy operation is started will be described with reference to the timing chart shown in FIG. 21. The bracketed letters (a) to (h) correspond to timings of the respective control operations.

While the size change zoom lens 106 is optimally set at the home position (a), the copy start key 201 is depressed (b), and the copy operation is started. Then, the paper sheet feed is started (c), and after a predetermined period of time the lamp 104 is turned on (d). The operation panel 103 and the original table are moved to scan the original surface (e). The original leading edge detection signal DTP from the photosensor 121 of the size change zoom lens 106 during scanning at the timing (e) is received (f). Since a white board for forming a leading edge margin in a copy image is arranged at the operation panel 103 and the original table, at the input timing (f) of the original leading edge detection signal DTP, a voltage of LOW level (2 V or lower) is supplied to the photosensor 121 (normal state) (g). In this period, the display 205 displays a set number of copies N. However, if this voltage of LOW level is not applied to the photosensor 121 for unexplained reason, it is determined that the photosensor 121 or the lamp 104 is abnormal. Contents (T) of the trouble are displayed at the display 205 (h), and the copy operation is stopped. In FIG. 21, the dotted line corresponds to the operation in the normal state.

Figure 22:
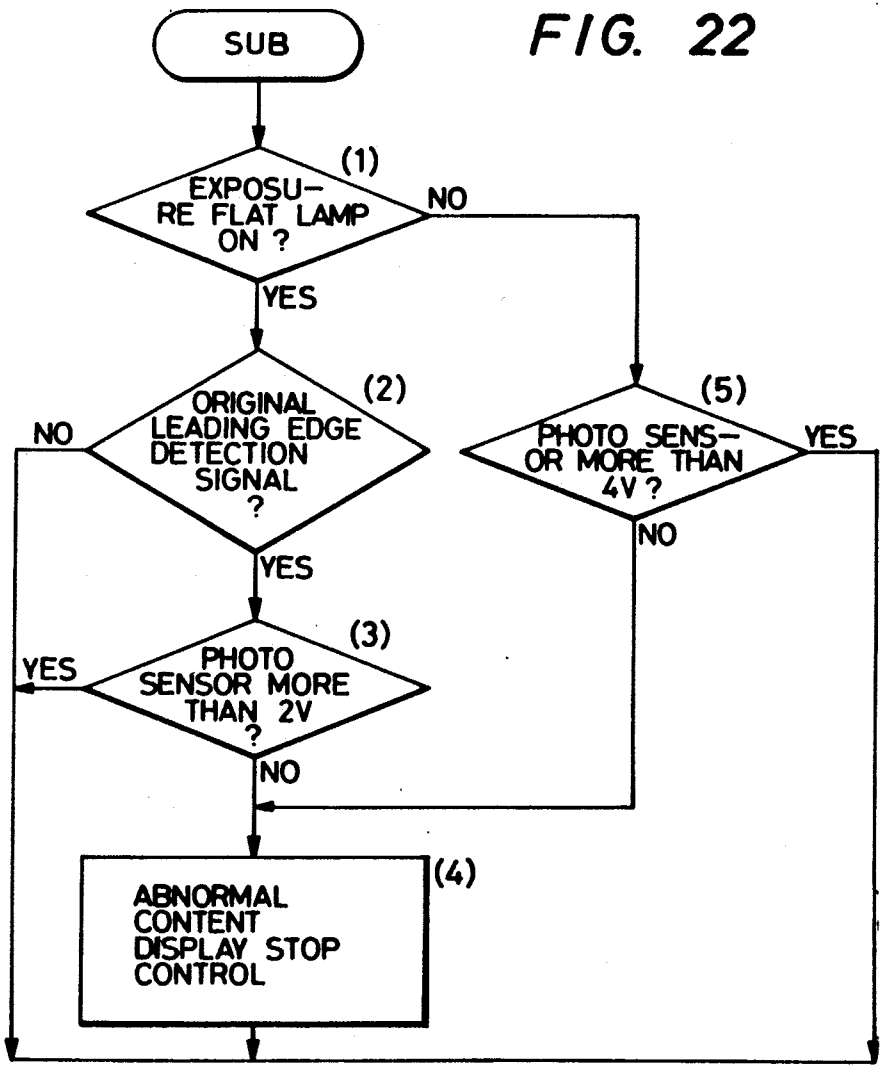

Stop control operation upon occurrence of a trouble will be described with reference to the flow chart shown in FIG. 22. The flow shown in FIG. 22 is started in response to a CALL command in the main program and is executed as needed. Note that numbers in brackets denote steps.

The flow shown in FIG. 22 is started when the copy start key 201 is depressed. It is first checked if the lamp 104 is turned on (1). If YES in step (1), it is checked if the original leading edge detection signal DTP is inputted (2). If YES in step (2), it is checked if the voltage of LOW level is applied to the photosensor 121 (3). If NO in step (3), the contents T of the trouble are displayed at the display 205, and the stop control operation is started. That is, the copy operation is stopped, and the flow returns to the main routine (4). However, if NO in step (1), it is checked if the applied voltage of the photosensor 121 is 4 V or higher (5). If NO in step (5), the flow jumps to step (4). However, if YES in step (5), the flow immediately returns to the main routine.

Still another example will be described below. In this example, a second density adjustment means is incorporated so that the density adjustment range can be changed in accordance with a change in the sensitivity of a photosensitive body. In this example, an optimal density can be obtained. Maintenance of the apparatus is easy, and the cost is reduced.

Figure 23:
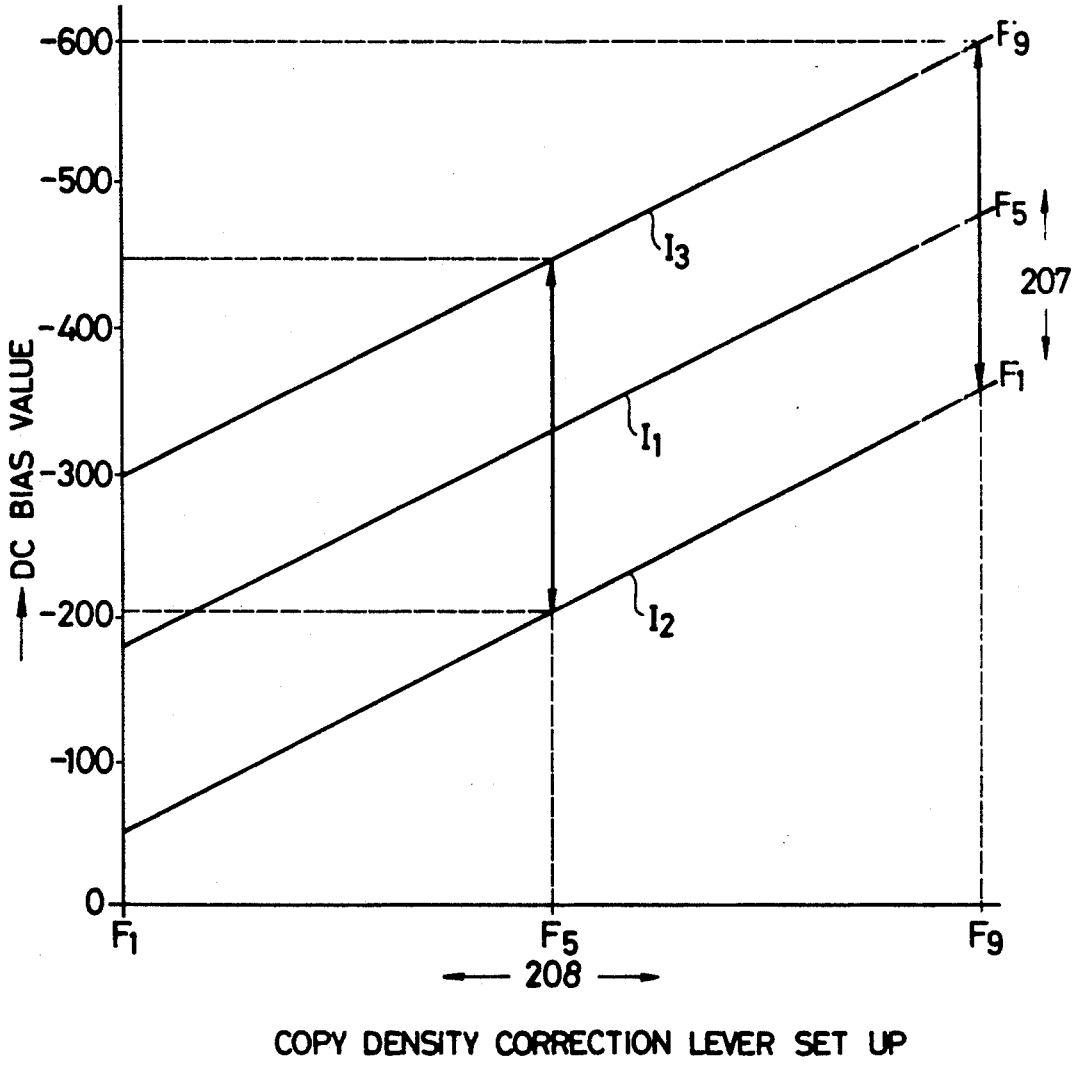
FIG. 23 is a graph showing density set up characteristics.

FIG. 23 is a graph showing the characteristics of the allowable range of the density bias of the copy density lever 207 and the copy density correction lever 208. The abscissa represents the density bias by the copy density correction lever 208, and the right ordinate represents the density bias by the copy density lever 207, while the left ordinate represents the DC bias. FIG. 23 shows a bias line $I_1$ of a reference density, a bias line $I_2$ lower than the reference density, and a bias line $I_3$ higher than the reference density. $F_1$ to $F_9$ correspond to displacement of the copy density correction lever 208 and the point $F_5$ is the central point. The operation will be described below.

The MP of the DC controller controls the DC bias by the DC bias control signal in accordance with the input values set by the copy density lever 207 and the copy density correction lever 208 on the operation panel 103 and the original table. The copy density lever 207 can change the DC bias voltage by 250 V, and the copy density correction lever 208 can change the DC bias voltage by 300 V. The DC bias voltages can therefore be changed within the range of −50 to −600 V.

However, when an operator actually depresses the copy start key 201, the copy density correction lever 208 is set at $F_5$. Then, by moving the copy density lever 207, the DC bias voltage can be changed within the range of about −200 to 31 450 V with reference to the line $I_2$ If the copy image density is lighter in intensity due to the surface state of the drum 108 or voltage fluctuations of the lamp 104 and the density is lighter than a desired density even after the copy density lever 207 is set at $F_9$, the copy density correction lever 208 is moved toward $F_9$ to increase the bias voltage, thereby obtaining an image of a desired density. Conversely, if the original density is darker than a desired level, the copy density correction lever is moved toward $F_1$ and an image of a desired density is obtained.

Scanner control will be described below.

Referring to FIG. 1, an optical system scanner (original table) 135 is driven by an optical system drive DC motor ($M_1$) 100. A main DC motor ($M_2$) 130 drives the photosensitive drum 108.

Home position detectors 131 and 136, and jam detectors 133 and 134 are arranged along the moving path of the scanner 135.

In this copy unit, the drum drive motor 130 drives the drum 108, the fixing unit 117, and the convey rollers 115 and 116. The optical system drive motor 100 drives only the original table 135. The drum drive motor 130 is controlled to rotate at a predetermined speed in one direction, and the optical system drive motor 100 is controlled to rotate in either direction at a speed corresponding to the selected magnification. These two motors are controlled separately. The rotational frequency of the optical system drive motor 100 is controlled to match with that of the drum drive motor 110.

FIG. 24 is a circuit diagram of a speed control circuit for the optical system scanner 135, the optical system drive motor 100, and the main motor 130 for driving the drum 108. A micro computer for motor speed control has a CPU 303. A circuit 502 generates a reference frequency signal FS by means of a counter (1) inside the micro computer. By a counter (2) inside the CPU 303, a circuit 304 generates a speed control signal FV of a predetermined pulse width in accordance with a motor speed designation (magnification information) in synchronism with an encoder output signal FG to be described later. An integrator port output 505 is selected in accordance with the magnification. Amplifiers 507 and 508 amplify the phase comparison signal PC and the speed control signal FV, respectively. An adder 509 adds the signals PC and FV. An integrator 511 integrates the sum signal from the adder 509. Comparators 515 and 516 perform pulse width modulation (PWM). H-type drivers 517, 518, 519 and 520 drive the optical drive motor 100 having the same reference numeral as that in FIG. 1. An encoder ($E_1$) 526 is mounted on the motor 100. The circuit includes a protective transistor 522. A logic circuit 531 encodes signals 528, 529 and 530 and determines the control operation of the optical system drive motor 100. Reference voltage generators 513 and 514 supply reference voltages to the comparators 515 and 516. A phase locked loop (PLL) control IC 556 drives a photosensitive drum drive motor indicated by 130 as in FIG. 1. An adder 553 adds the signals PC and FV. The circuit further includes a rectangular wave generator 554, an integrator 555, a comparator 552 for generating the PWM signal, a driver 559 for driving the drum drive motor 130, and an encoder (E) mounted on the motor 130.

The operation of the circuit shown in FIG. 24 will be described.

When the copy magnification is set and the copy start key is depressed, a master CPU 525 transmits magnification information to the micro computer CPU 303 through a serial communication line 534. An ON signal 550 for the main motor (drum drive motor 130) is produced to activate the PLL control IC 556. The amplifier 553 adds the phase comparison signal PC and the speed control signal FV. A rectangular wave from the rectangular wave generator 554 is integrated by the integrator 555 to generate a triangular wave. The sum signal of the signals PC and FV and the triangular wave are compared by the comparator 552 to produce a PWM signal. The PWM signal is supplied to the driver 559. An output from the encoder 560 mounted on the driver 559 is supplied to the PLL control IC 556. The encoder signal and the reference frequency from the clock generator 557 are phase-compared so that the main motor 130 is driven at a predetermined speed. A resistor 558 is for detecting a current. When the main motor 130 is started, a rush current flows. The resistor 558 detects this current to operate a current limiter 551 and to turn off the driver 559.

The control operation for the optical system drive motor 100 will be described below. When the copy start signal is supplied, the master CPU 525 supplies optical forward and start signals 528 and 529. The logic circuit 531 generates a forward ON signal and a forward reference selection signal.

Magnification information supplied through the serial communication line 534 is encoded by the motor control CPU 303. The encoded result is returned to the master CPU 525 and is matched with the original information. When the information matches with each other, the reference frequency generator 502 determines a count of a timer for generating a reference frequency signal FS corresponding to the selected magnification. A signal for selecting a capacitor of the integrator 511 is produced, and a selected analog switch 533 is opened. The count value for actuating a speed control signal FV generator 504 is determined in accordance with the magnification information.

The phase difference (comparison) signal PC and the speed control signal FV from the motor control CPU 303 are amplified by the amplifiers 507 and 508, respectively, and the amplified signals are added by the adder 509. The sum signal from the adder 509 is integrated by the integrator 511. The integrated signal from the integrator 511 and the forward reference voltage 513 are compared by the comparator 515 and a PWM signal is generated. The PWM signal is supplied to the driver 517. Since the driver 520 is turned on by the logic circuit 531, a current flows to the optical system drive motor 100. The motor 100 is controlled such that the phase of the reference frequency signal corresponding to the magnification information and that of the encoder feedback signal FG from the encoder 526 mounted on the motor 100 are kept constant.

The resistor 521 is for detecting a current which is connected to the current limiter 523 and an analog input 561 of the motor control CPU 303. When the motor 100 is started, the current limiter 523 is actuated to turn off the driver 520.

In order to detect an overcurrent, the current is supplied to an analog input 562 of the motor control CPU 303. When the received current exceeds a predetermined level, the driver protection transistor 522 is turned off. When, for example, both the drivers 517 and 519 are turned on, a short circuit is formed between the power source and GND and an overcurrent flows. Then, overcurrent detection is started. The driver protection transistor 522 is normally ON. A switch 132 is an optical system overrun switch. When the optical system overruns, the switch 132 is opened to forcibly stop the motor 100.

The forward time is determined by the master CPU 301 in accordance with the magnification information, cassette size or the like. After the forward signal 528 is turned on for a predetermined period of time, a back signal is inputted. The backward control is performed in a similar manner to that of the forward control. However, in the backward control, the speed control signal FV alone is used, and the phase error signal PC is not used.

When the master CPU 301 detects the home position sensor 136 of the potical system scanner 135 during the back control, the back signal is produced for a predetermined period of time, the driver 520 alone is turned on, and a dynamic brake is applied to stop the scanner 135 at the predetermined position.

A bipolar electrolytic capacitor 527 shown in FIG. 24 is connected in parallel with the optical system drive motor 100. "Phase lock" state is the state wherein the motor 100 is rotated at a predetermined speed, i.e., the phase difference between the reference frequency signal FS and the encoder feedback signal FG of the motor is kept constant. This state is established to reinforce the locking force, i.e., not to cancel the phase lock state. This is because, in a copy unit of the original table moving type, the original table can be pressed by the hand of the operator. When the capacitor 527 is added, the motor rotational frequency is changed within a wide range including a case of continuous size change.

The control method of the phase difference signal PC and the speed control signal FV will be described in sequential order in accordance with the program flow charts shown in FIGS. 25-1 and 25-2.

After the power source is turned on, the motor control CPU 303 (FIG. 24) is started. The MAIN program as shown in FIG. 25-1 is started. Initialization of the ports or the like is performed (step 300). Magnification information from the master CPU 301 is received by the motor control CPU 303 through the serial communication line 534 (step 301). The magnification information is encoded (step 302), and the data is transmitted for matching by the master CPU 301 (step 303). A timer count value is calculated in order to generate the reference frequency signal FS and the speed control signal FV matched with the set speed of the optical system drive motor 100, in accordance with the encoded magnification information (step 304). As for the method of generating the reference frequency signal FS, after the count-down operation of the counter (1) ends, an interrupt signal is generated, the count value is automatically reset, and the count-down operation is repeated.

The encoder signal from the encoder 526 mounted on the optical system drive motor 100 is supplied as an interrupt signal to the motor control CPU 303 (563 in FIG. 24). Whether or not speed control is being performed correctly is discriminated by counting the number of encoder signals and the number of reference frequency signals determined by the preset magnification. Therefore, if the speed of the original table 135 is faster than the set speed, when the self-diagnosis is performed and an abnoarmality is detected (step 304'), the motor control CPU 303 signals the abnormality to the master CPU 301 by serial communication Upon reception of an abnormality signal, the master CPU 301 supplies a back signal to the driver of the optical system drive motor 100 to move the original table 135 backward and stop it at the home position.

After the original table 135 is stopped at the home position, the master CPU 301 performs an abnormality display at the operation panel and stops the copy operation.

Assume a case wherein the speed detector fails and a command for driving the motor 100 is produced under the absence of the speed signal (encoder signal; normally H or L). In this case, the motor control CPU 303 monitors the encoded signal of the optical system drive motor 100 to confirm the abnormality of the speed detector. Then, the abnormality is detected by the self-diagnosis program and is signalled to the master CPU 301.

The speed control signal FV will be described below.

Figures 1A, 25:
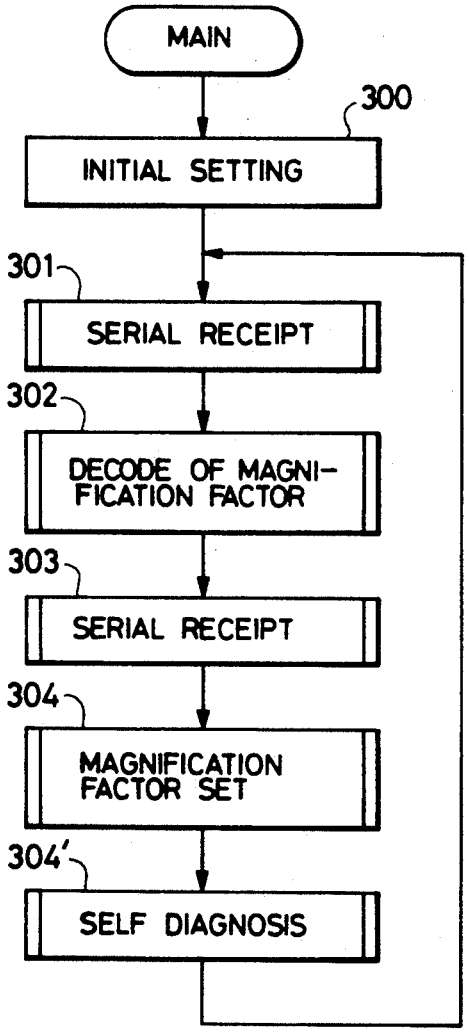
FIGS. 25-1A, 25-1B, 25-2A and 25-2B are program operation flow charts of the control circuit shown in FIG. 24.
Figures 1B, 25:
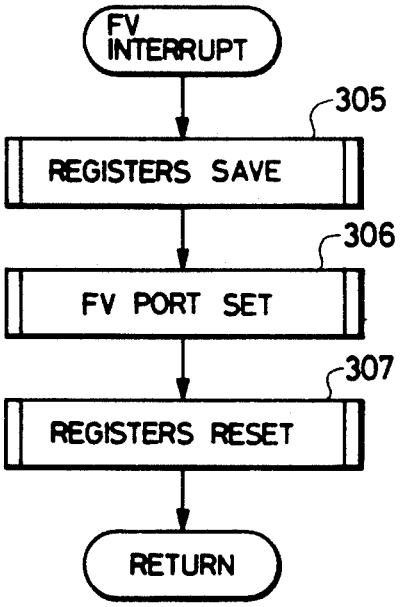
Figures 2A, 25:
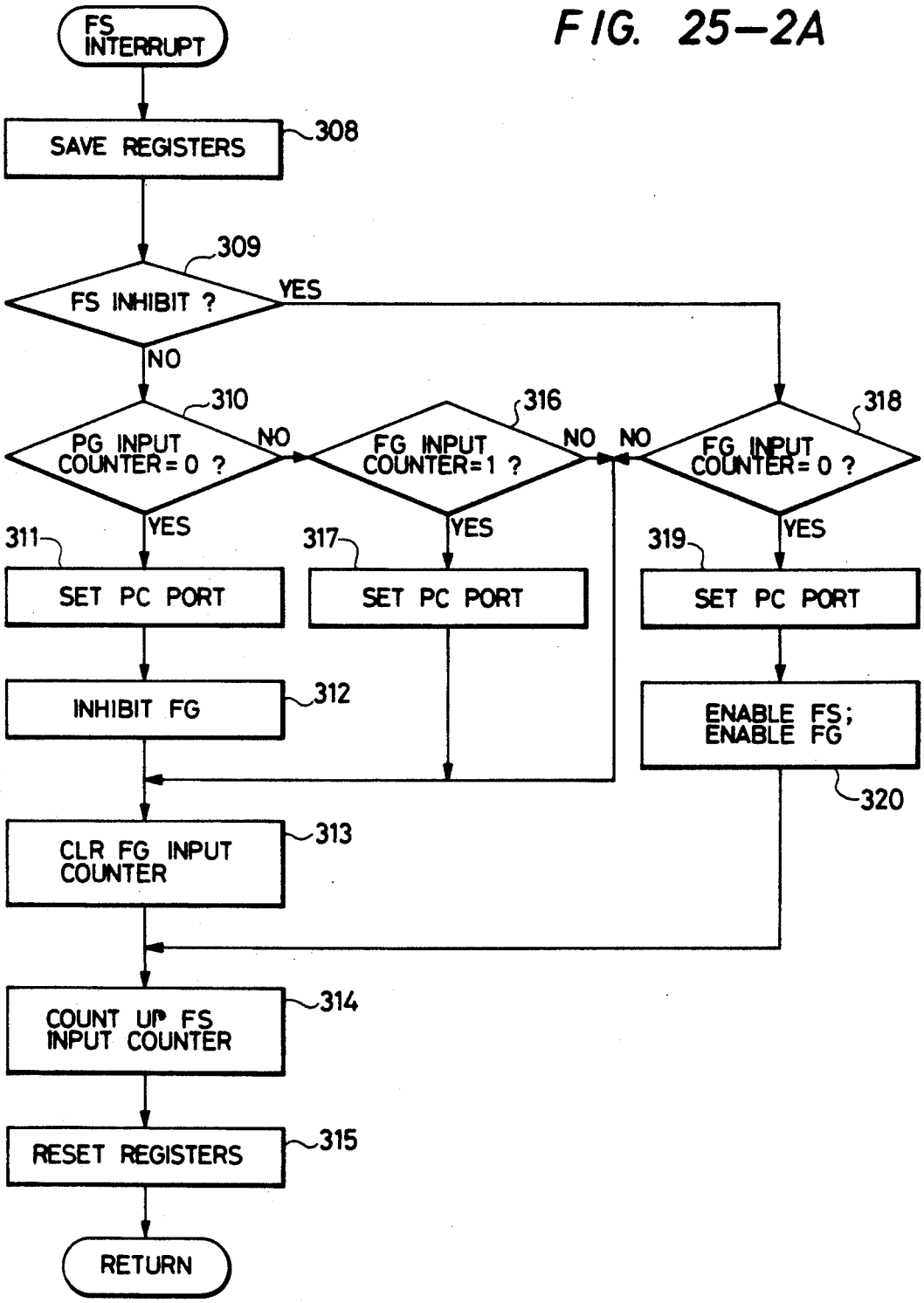
Figures 2B, 25:
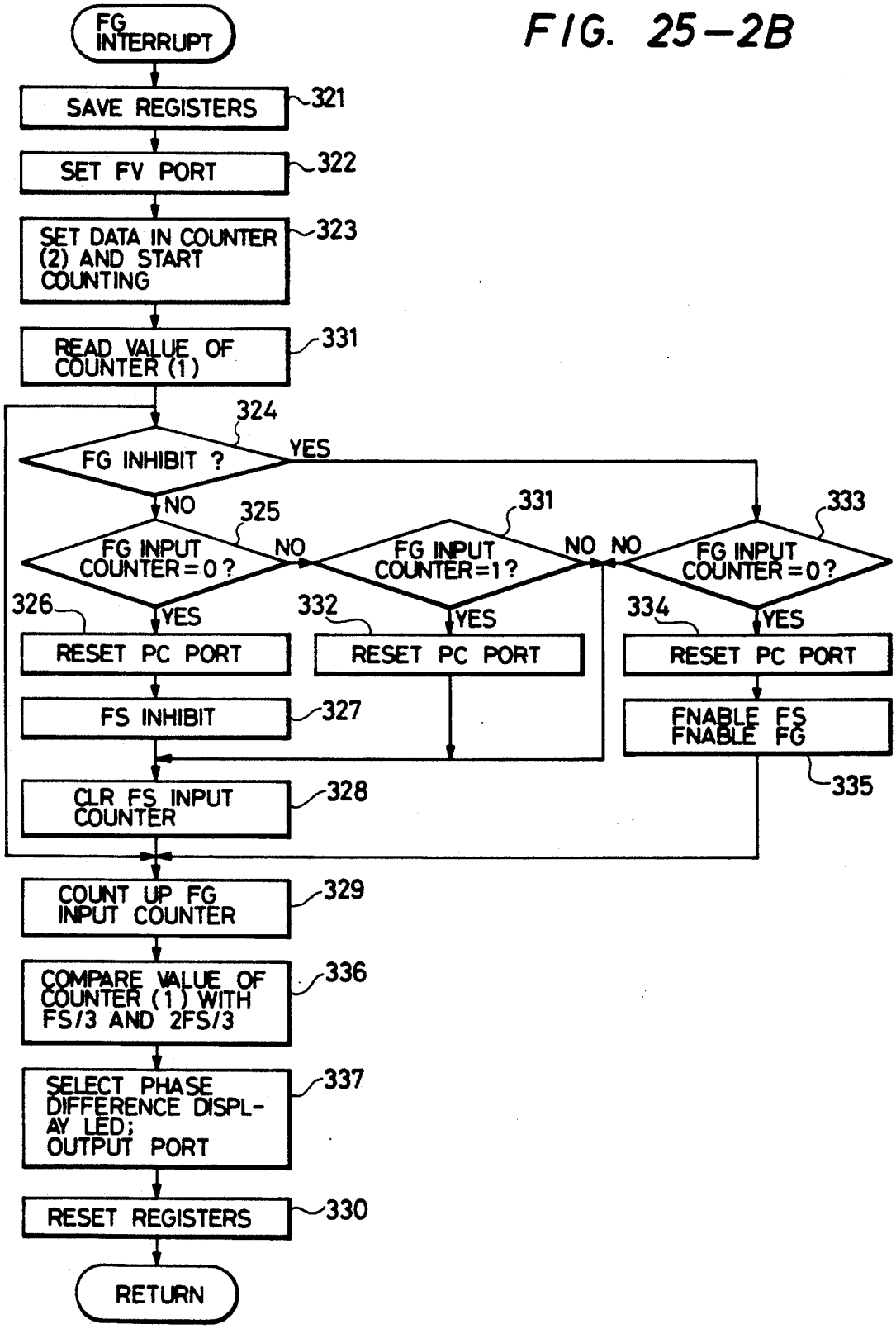

The speed control signal FV generator 504 inside the motor control CPU 303 shown in FIG. 24 corresponds to the FV interrupt program shown in FIG. 25-1 and the FG interrupt program shown in FIG. 25-2. The FG interrupt is started in response to the trailing edge of the encoder feedback signal FG from the encoder 526 of the optical system drive motor 100. After the data save in the register (step 321), the speed control signal FV is reset (322), a count value corresponding to the magnification is set in the counter (2) and the counter (2) is started (step 323). After the counter (2) completes counting down, the FV interrupt is started. After data save in the registers (step 305 in FIG. 25-1), the signal FV is set (step 306). After the signal FV is generated, the registers are reset (step 307).

Figure 26:
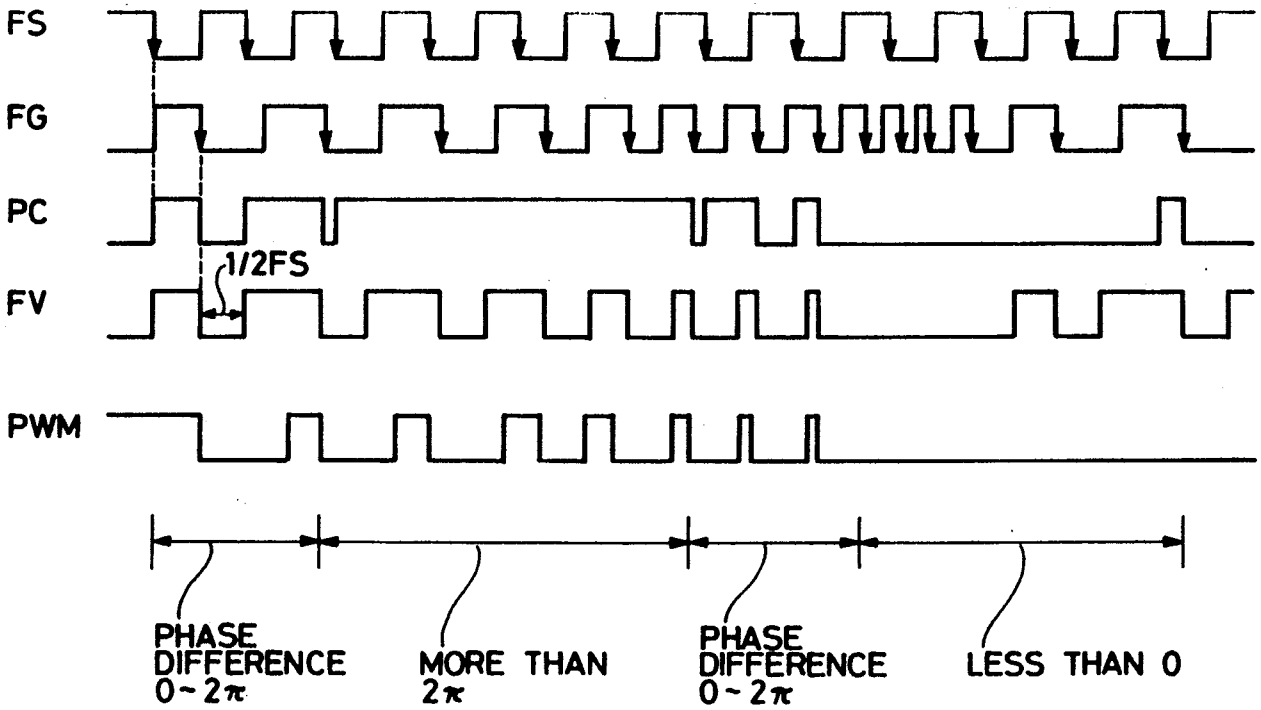
FIG. 26 is a diagram showing the waveforms of signals.

FIG. 26 shows the waveforms of the respective signals. The phase comparison signal PC is set or reset at the trailing edges of the reference frequency signal FS and the encoder feedback signal FG when the phase difference is 0 to 2 $\pi$. When the phase of the feedback signal FG is delayed by more than 2 $\pi$, the phase comparison signal PC is set. After detecting two trailing edges of the feedback signal FG within one period of the reference frequency signal FS, the above phase difference (0 to 2 $\pi$) operation is repeated When the phase of the feedback signal FG is advanced, i.e., the phase difference is 0 or less, the phase comparison signal PC is kept reset. After detecting two trailing edges of the reference frequency signals FS during one period of the feedback signal FG, the phase difference (0 to 2 $\pi$) operation is repeated The forward movement control of the optical system will be described with reference to FIG. 25-2. When the phase difference is 0 to 2 $\pi$, as shown in FIG. 26, the signal FS is enabled and FG input counter=1. Therefore, in response to the FS interrupt signal, steps 308, 309, 310 and 316 are performed to set the PC port of the motor control CPU 303 (step 317), and the counter for counting the number of FG interruptions is cleared (step 313). The counter for counting the number of FS interruptions is counted up (step 314). The registers are reset and at the same time an interruption is enabled (step 315). The flow then returns. The FG interrupt signal is enabled in accordance with this series of operations.

In the same manner as described above, the FG interrupt signal is enabled, and the FS input counter =1 is established. Thus, the PC port is reset in response to the FG interrupt signal through steps 324, 325 and 331 (step 332), the counter for counting the number of FS interrupts is cleared (step 328), the counter for counting the number of FG Interrupts is counted up (step 329), and the interrupt is permitted simultaneously when the registers are reset (step 330). In accordance with the sequence described above, the FS interrupt signal is enabled.

The FG and FS interrupt signals are alternately sent.

When a phase difference is more than 2$\pi$ in FIG. 26, the FS interrupt signal is enabled and the FG input counter=0 is established in the initial state, so that the PC port is set through steps 308, 309, 310 and 316 in the same manner described above (step 317). The counter for counting the number of FG interrupts is cleared (step 313), the counter for counting the number of FS interrupts is counted up (step 314), and the interrupt is permitted simultaneously when the registers are reset (step 315). The flow returns to the main routine again, and the FS interrupt signal is inputted again. The PC port is set (step 311) while the FG input counter="0" is established, and an FG inhibit flag is set (step 312). The counter for counting the number of FG interrupts is cleared (step 313), the counter for counting the number of FS interrupts is counted up (step 314), and the interrupt is permitted simultaneously when the registers are reset (step 315). Thereafter, the flow returns to the main routine. In this state, the FG interrupt signal is inhibited and the FS input counter $\neq$0 is established, so that the PWM is performed by the driver 517 (FIG. 2) to advance the phase of the optical system drive motor 100 through steps 324, 333, 328, 329 and 330 In this case, the driver 520 is kept ON. The phase of the feedback signal FG is advanced, and the FG interrupt signal is inputted. When the count of the counter for counting the number of FG interrupts is "0", the PC port is reset through decision blocks of steps 324 and 333 (step 334). The flag is reset to permit the FS and FG interrupts (step 335). The flow returns to the main routine through steps 329 and 330. Thereafter, the state given by the phase differences 0 to 2$\pi$ is repeated.

However, when the phase of the feedback signal FG is advanced, the relationship between the interrupt signals FS and FG is reversed unlike the relationship obtained when the phase is lagged. The PWM is performed by the driver 217 to delay the phase of the motor 100 through steps 326, 327, 318, 319 and 320 so as to obtain the phase difference of 0 to 2$\pi$. In this case, the PWM is used to drive the motor 100. However, the DC level may be used in place of the PWM.

The display LED 535 in FIG. 4 indicates a phase difference. When three phase difference display LEDs are used, a method of selecting these LEDs will be described with reference to FIGS. 25-1 and 25-2. The count representing the reference frequency FS obtained by the set magnification is divided into three values which are stored in the memory (step 304). A count of the counter (1) of the reference frequency generator 502 is read in response to the encoder signal FG interrupt of the optical system drive motor 100 (step 331). The count FS/3 of the FS is compared with 2FS/3 (step 336) to discriminate which LED of the phase difference display LEDs 235 must be turned on. A discrimination signal is supplied to the port (step 337).

Finally, a general description of the copy sequence will be made with reference to FIG. 1.

When a copy start key of an operation panel of the copy unit is depressed, the photosensitive drum drive motor 102 is controlled to be rotated at a predetermined speed as previously described. At the same time, the optical system scanner (original table) drive motor 100 is controlled to rotate at a rotational speed corresponding to the set magnification. A recording paper sheet is fed by the pickup roller 15, and a latent image is formed by an exposure lamp on the photosensitive drum 108. The latent image is visualized by the developing agent, and the visible image is transferred to the recording paper sheet. The paper sheet is fed by the convey rollers 115 and 116, and the visible image on the paper sheet is fixed by the fixing unit 117. The fixed paper sheet is exhausted outside the copy machine.

The jam detectors 133 and 134 are arranged on the convey rollers 115 and 116 and the fixing unit 117, respectively. The jam detectors 133 and 134 detect jamming when the paper sheet is not fed within a predetermined period of time or when the paper sheet is held in the copy machine longer than the predetermined period of time. A jam detection signal is supplied to the master CPU 301 which then detects an abnormal operation. The master CPU 301 stops supplying the forward signal to the motor control CPU 303 so as to cause the optical system scanner (original table) 135 to return to the home position (sensor B6) and supplies the back signal to automatically cause the original table 135 to return to the home position.

What is claimed is:

1. An image processing apparatus comprising:

magnification input means for inputting a magnification for image formation;

means for forming an image on a paper sheet;

means for forming a margin on the paper sheet; and control means for controlling said image forming means so as to form the margin of a predetermined size even when the input magnification changes, said control means having first timer means for effecting a timing operation based on a predetermined time irrespectively of the input magnification and second timer means for effecting a timing operation based on the input magnification with a predetermined time relation to said first timer means.

2. An apparatus according to claim 1, wherein said first timer means terminates the timing operation thereof at substantially the same time as said second timer means when the magnification is an equal size.

3. An apparatus according to claim 1, wherein said control means adjusts a set time of said second timer in accordance with the input magnification on the basis of a set time of said second timer for a magnification of an equal size.

4. An apparatus according to claim 1, wherein said control means controls said image forming means is response to termination of a timing operation of said second timer.

5. An image processing apparatus comprising:

magnification input means for inputting a magnification for image formation;

numeral input means for inputting a numeral associated with image formation;

common display means for displaying the numeral associated with image formation and the inputted magnification;

timer means for counting a predetermined time period; and control means for starting said timer means in response to the entry of a magnification by said magnification input means; for charging a display on said display means from the numeral inputted by said numeral input means to the magnification inputted by said magnification input means while said timer means is counting; and, for displaying again the numeral in place of said magnification when said timer period is over;

wherein when it is detected during counting of said timer means that a modified magnification is inputted through said magnification input means, said control means resets said timer means, starts said timer means and displays the modified magnification.

6. An apparatus according to claim 5, further comprising output means for outputting an analog value corresponding to the magnification inputted by said magnification input means.

7. An apparatus according to claim 6, wherein said output means comprises a variable resistor.

8. An apparatus according to claim 5, further comprising instruction means for displaying a magnification without modification of the magnification inputted through said magnification input means.

9. An apparatus according to claim 8, wherein said control means controls said timer means in response to an input from said instruction means.

10. A magnification setting apparatus, comprising:

a manually movable member including means for outputting an analog signal value which is continuously variable in accordance with a position of said movable member;

analog/digital converting means for converting an analog value corresponding to a position of said movable member into a digital value;

first setting means for directly setting a magnification for image formation corresponding to a position of said movable member in accordance with the digital value converted by said converting means; and second setting means for setting a predetermined specified magnification irrespective of a position of said movable member.

11. An apparatus according to claim 10, further comprising a zoom lens for image formation and control means for controlling an actuation of the zoom lens in accordance with a determined magnification factor.

12. An apparatus according to claim 10, wherein said movable member includes a variable resistor.

13. An apparatus according to claim 10, wherein said second setting means comprises in put means for selecting said specified magnification.

14. An apparatus according to claim 10, wherein said second setting means sets said specified magnification in response to power-on of said apparatus.

15. An apparatus according to claim 10, further comprising means for selecting one of the magnification setting by said first setting means and the magnification setting by said second setting means.

16. An image processing apparatus, comprising:

image forming means;

magnification input means for inputting a magnification, said input means including a manually movable member, said input means outputting a magnification signal corresponding to a position of said movable member;

memory means for storing the magnification inputted by said input means;

control means for continuously retained a magnification stored at a start of image formation, with the magnification stored by said control means being retained even beyond completion of image formation and even when a position of said movable member changes before completion of image formation;

means for selecting said retained magnification or a magnification corresponding to a position of said movable member changed before completion of image formation, without changing a position of said movable member after completion of the image formation.

17. An apparatus according to claim 16, wherein said input means comprises a variable resistor.

18. An apparatus according to claim 16, wherein said selecting means selects the retained magnification when an instruction for starting image formation is conducted after completion of the image formation.

19. An apparatus according to claim 16, wherein said control means includes means for comparing the magnification at a start of the image formation with the magnification corresponding to the position of said movable member at the end of the image formation, and said apparatus further comprises means for issuing a warning when the magnification at a start of the image formation and the magnification corresponding to the position of said movable member at the end of the image formation are not consistent with each other.

20. An image forming apparatus comprising:

image forming means;

a source for illuminating an original;

density detecting means for detecting a density of the original image on the basis of a reflected light from the illuminated original;

failure detection means for detecting failure of said density detecting means or said illuminating means in accordance with an output of said density detecting means; and control means for stopping an operation of said image forming means when said failure detecting means detects a failure, and for controlling a density of an image formed by said image forming means in accordance with an output of said density detecting means when said failure detecting means detects no failure.

21. An apparatus according to claim 20, wherein said failure detecting means performs an operation thereof when an image forming operation starts.

22. An apparatus according to claim 21, further comprising means for detecting a leading edge of an image, wherein said failure detecting means determines a failure when said leading edge detecting means detects a leading edge of an image and said density detecting means does not generate a signal representing a low density.

23. An apparatus according to claim 20, wherein said failure detecting means performs an operation thereof during a waiting period for image formation.

24. An apparatus according to claim 23, wherein said failure detecting means determines a failure when said density detecting means does not generate a signal representing a high density.

25. An image forming apparatus, comprising:

means for inputting a stepless magnification for image formation;

scanning means for scanning an original at a speed based on the magnification input through said input means;

image forming means for forming onto a record medium an image of an original scanned by said scanning means;

transferring means for transferring to a sheet an image formed on said record medium;

a density member for forming an image of predetermined density onto a leading edge of the recording medium, wherein said density member sets a predetermined density level and is scanned by said scanning means instead of a leading edge of an original;

detecting means for detecting a position corresponding to a leading edge of the original while the original is scanned; and forming means for forming a predetermined volume of a margin onto the record medium irrespective of a magnification input through said input means, by executing a transfer process at a timing corresponding to the magnification after the position is detected by said detecting means.

26. An apparatus according to claim 25, further comprising means for counting the time elapsed after detecting said position by said detecting means, wherein said margin forming means controls a timing of the transfer by said transfer means by changing a count value of said counting means in accordance with a magnification input through said input means.

27. An apparatus according to claim 26, further comprising means for feeding said sheet toward said transfer means, wherein said margin forming means controls a timing of the feed by said feeding means in accordance with said count value.

28. An apparatus according to claim 26, wherein said count means counts the sum of a fixed count value independent of a magnification and a variable count value based on a magnification.

29. An apparatus according to claim 25 further comprising a standard density member having a white level, wherein said margin forming means forms a margin by scanning said standard density member by said scanning means.

30. An apparatus according to claim 25, wherein said density member has a white density level.

* * * * *

UNITED STATES PATENT AND TRADEMARK OFFICE

CERTIFICATE OF CORRECTION

PATENT NO. : 5,239,341

DATED : Masato Ishida, et al.

INVENTOR(S) : August 24, 1993

It is certified that error appears in the above-identified patent and that said Letters Patent is hereby corrected as shown below:

COVER PAGE

Under [56] References Cited, U.S. Patent Documents, "Osano et al." should read --Osanai et al.--.

Under [56] References Cited, Foreign Documents, please insert

| | | |
|---|---|---|
| --3239007 | 5/1983 | Fed. Rep. of Germany |
| 3014833 | 11/1980 | Fed. Rep. of Germany--. |

Under [57] Abstract, line 21, "to" should read --of--

COLUMN 13

Line 60, "speed v.An" should read --speed v. An--.

COLUMN 16

Line 18, "stated" should read --started--.

UNITED STATES PATENT AND TRADEMARK OFFICE

CERTIFICATE OF CORRECTION

PATENT NO. : 5,239,341

DATED : Masato Ishida, et al.

INVENTOR(S) : August 24, 1993

It is certified that error appears in the above-identified patent and that said Letters Patent is hereby corrected as shown below:

COLUMN 19

Line 39, "31 450 V" should read -- -450V --.

Signed and Sealed this

Thirtieth Day of May, 1995

Bruce Lehman

*Attest:*

BRUCE LEHMAN

*Attesting Officer*

*Commissioner of Patents and Trademarks*